US008608942B2

(12) United States Patent
Subramanian et al.

(10) Patent No.: US 8,608,942 B2
(45) Date of Patent: Dec. 17, 2013

(54) SYSTEMS AND METHODS FOR RESIDUE UPGRADING

(75) Inventors: Anand Subramanian, Sugar Land, TX (US); Phillip K. Niccum, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 1320 days.

(21) Appl. No.: 12/047,115

(22) Filed: Mar. 12, 2008

(65) Prior Publication Data

US 2008/0223754 A1 Sep. 18, 2008

Related U.S. Application Data

(60) Provisional application No. 60/895,023, filed on Mar. 15, 2007.

(51) Int. Cl.
*C10C 3/08* (2006.01)

(52) U.S. Cl.
USPC ..... 208/86; 208/309; 208/106

(58) Field of Classification Search
USPC ..... 208/86, 309
See application file for complete search history.

(56) References Cited

U.S. PATENT DOCUMENTS 2,940,920 A 6/1960 Garwin
3,287,254 A * 11/1966 Paterson ..... 208/86
3,647,682 A 3/1972 Rabo et al.
3,975,396 A 8/1976 Bushnell et al.
4,039,429 A 8/1977 van Klinken et al.
4,191,639 A 3/1980 Audeh et al.
4,200,519 A 4/1980 Kwant et al.
4,267,034 A 5/1981 Carter
4,290,880 A 9/1981 Leonard
4,324,651 A 4/1982 Rollmann et al.
4,354,922 A 10/1982 Derbyshire et al.
4,354,928 A 10/1982 Audeh et al.
4,404,095 A 9/1983 Haddad et al.
4,419,221 A 12/1983 Castagnos, Jr. et al.
4,421,639 A 12/1983 Lambert et al.
4,440,633 A 4/1984 Jacquin et al.
4,482,453 A 11/1984 Coombs et al.
4,502,950 A 3/1985 Ikematsu et al.
4,525,269 A 6/1985 Ikematsu et al.
4,547,292 A 10/1985 Zarchy
4,810,367 A 3/1989 Chombart et al.
4,828,679 A 5/1989 Cormier, Jr. et al.
4,933,067 A 6/1990 Rankel
4,940,529 A * 7/1990 Beaton et al. ..... 208/86
4,980,053 A 12/1990 Li et al.
4,997,545 A 3/1991 Krishna et al.
5,043,522 A 8/1991 Leyshon et al.
5,089,114 A 2/1992 Tovar et al.
5,192,421 A * 3/1993 Audeh et al. ..... 208/86
5,198,590 A 3/1993 Sofranko et al.
5,202,520 A * 4/1993 Forte ..... 208/311
5,326,465 A 7/1994 Yongqing et al.
5,523,502 A 6/1996 Rubin
5,843,303 A 12/1998 Ganeshan
5,914,010 A 6/1999 Hood et al.
5,919,355 A 7/1999 Hood
6,069,287 A 5/2000 Ladwig et al.
6,090,270 A * 7/2000 Gildert ..... 208/212
6,123,830 A 9/2000 Gupta et al.
6,171,471 B1 1/2001 Ferrughelli et al.
6,274,032 B2 8/2001 Hood et al.
6,287,522 B1 9/2001 Lomas
6,313,366 B1 11/2001 Ladwig et al.
6,332,975 B1 12/2001 Abdel-Halim et al.
6,339,181 B1 1/2002 Chen et al.
6,388,161 B1 5/2002 Dath et al.
6,524,469 B1 2/2003 Schucker
6,533,925 B1 3/2003 Wallace et al.
6,538,169 B1 3/2003 Pittman et al.
6,569,316 B2 5/2003 Winter
6,602,920 B2 8/2003 Hall et al.
6,635,792 B2 10/2003 Choi et al.
6,642,425 B2 11/2003 Winder et al.
6,652,737 B2 11/2003 Touvelle et al.
6,977,321 B1 12/2005 Dath et al.
7,011,740 B2 3/2006 Tallman et al.
7,019,188 B2 3/2006 Smith et al.
7,128,827 B2 10/2006 Tallman et al.
7,144,498 B2 12/2006 McCall et al.

(Continued)

OTHER PUBLICATIONS

Wang, Longyan; Yang, Bolun; Wang, GUoliang; Tang, Haitao, "New FCC process minimizes gasoline olefin, increases propylene" Oil &Gas Journal; Feb. 10, 2003; 101.6; p. 52.*
Perry, R.H.; Green, D.W. (1997). Perry's Chemical Engineers' Handbook (7th Edition).. McGraw-Hill; Chapter 25. Online version available at: http://www.knovel.com/web/portal/browse/display?_EXT_KNOVEL_DISPLAY_bookid=48&VerticalID=0.*
Cretoiu, Lucia, et al. "Sulfur Reduction With No Octane Loss-GT-DeSulf," ERTC Annual Meeting, Paris, France, Nov. 18-20, 2002.
Gentry, Joseph C. and Fu-Ming Lee. "Novel Process for FCC Gasoline Desulfurization and Benzene Reduction to Meet Clean Fuels Requirements," 2000 NPRA Annual Meeting San Antonio, Texas, Mar. 27, 2000.
Phillips, Graham et al. "Advances in residue upgrading technologies offer refiners cost-effective options for zero fuel oil production," pp. 1-31, 2002 European Refining Technology Conference, Paris, France, Nov. 2002.

(Continued)

*Primary Examiner* — Prem C Singh
*Assistant Examiner* — Michelle Stein
(74) *Attorney, Agent, or Firm* — Gary M. Machetta

(57) ABSTRACT

Systems and methods for processing hydrocarbons are provided. A hydrocarbon can be distilled to provide a distillate, a gas oil, and a residue. The residue can include, but is not limited to asphaltenes and non-asphaltenes. The residue can be mixed with a solvent to provide a mixture. The asphaltenes can be selectively separated from the mixture to provide a deasphalted oil. At least a portion of the deasphalted oil and at least a portion of the gas oil can be hydroprocessed to provide a hydroprocessed hydrocarbon. At least a portion of the distillate and at least a portion of the hydroprocessed hydrocarbon can be cracked in a first reaction zone to provide a first cracked product comprising C2 hydrocarbons, C3 hydrocarbons, C4 hydrocarbons, and naphtha.

1 Claim, 4 Drawing Sheets

(56) References Cited

U.S. PATENT DOCUMENTS

| | | | |
|---|---|---|---|
| 7,153,479 | B2 | 12/2006 | Peterson et al. |
| 7,301,063 | B2 | 11/2007 | Choi et al. |
| 2002/0000085 | A1 | 1/2002 | Hall et al. |
| 2002/0043477 | A1 | 4/2002 | Winter |
| 2002/0063082 | A1 | 5/2002 | Touvelle et al. |
| 2002/0092797 | A1 | 7/2002 | Choi et al. |
| 2003/0171630 | A1 | 9/2003 | Winder et al. |
| 2004/0069681 | A1 | 4/2004 | Peterson et al. |
| 2004/0069684 | A1 | 4/2004 | Tallman et al. |
| 2004/0225172 | A1 | 11/2004 | Smith et al. |
| 2005/0150817 | A1 | 7/2005 | Tallman et al. |
| 2005/0167333 | A1 | 8/2005 | McCall et al. |
| 2006/0287561 | A1 | 12/2006 | Choi et al. |
| 2007/0042904 | A1* | 2/2007 | Xie et al. ..... 502/305 |
| 2007/0083071 | A1 | 4/2007 | Choi et al. |

OTHER PUBLICATIONS

Plain, C. et al. "Options for Resid Conversion," Oct. 8-9, 2002, pp. 1-10, Axens IFP Group Technologies, Istambul. http://www.axens.net/upload/presentations/fichier/options_for_resid_conversion.pdf.

* cited by examiner

SYSTEMS AND METHODS FOR RESIDUE UPGRADING

CROSS-REFERENCE TO RELATED APPLICATION

This application claims the benefit of U.S. Provisional Application No. 60/895,023 filed on Mar. 15, 2007, the disclosure of which is incorporated by reference herein in its entirety.

BACKGROUND

1. Field

The present embodiments generally relate to systems and methods for processing hydrocarbons. More particularly, embodiments of the present invention relate to systems and methods for producing olefins from crude.

2. Description of the Related Art

Crude topping units can be used to separate naphthas from crude to provide a naphtha feed for a Benzene, Toluene, Xylene ("BTX") unit, which processes the naphthas into valuable products. In addition to the valuable products, crude topping units produce a large amount of residue that can be sold as a heavy fuel oil, sent to refineries for further processing, or sold on the market to refineries with bottom of the barrel processes can that take advantage of the residue.

Crude topping units are inefficient and leave naphthas in the residue. The residue can be further processed to extract more naphtha from the residue, however, current refining methods, such as vacuum tower distillation, are inefficient processes for further extracting naphtha from the residue. Additionally, current refining methods can also harm the environment. For example, many residue upgrading processes, such as vacuum distillation and coking rely on fired heaters that generate large amounts of carbon monoxide ("CO") and nitrogen oxides ("NOx") emissions. Furthermore, current processes require large capital costs, plot area, and energy consumption, and produce unwanted low value byproducts.

There is a need, therefore, for improved systems and methods for upgrading crude residue into more valuable hydrocarbon products.

BRIEF DESCRIPTION OF THE DRAWINGS

So that the manner in which the recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes can be recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent can be combined with available information and technology.

Systems and methods for processing hydrocarbons are provided. A hydrocarbon can be distilled to provide a distillate, a gas oil, and a residue. The residue can include, but is not limited to asphaltenes and non-asphaltenes. The residue can be mixed with a solvent to provide a mixture. The asphaltenes can be selectively separated from the mixture to provide a deasphalted oil. At least a portion of the deasphalted oil and at least a portion of the gas oil can be hydroprocessed to provide a hydroprocessed hydrocarbon. At least a portion of the distillate and at least a portion of the hydrotreated hydrocarbon can be cracked in a first reaction zone to provide a first cracked product comprising $C_2$ hydrocarbons, $C_3$ hydrocarbons, $C_4$ hydrocarbons, and naphtha.

Figure 1:
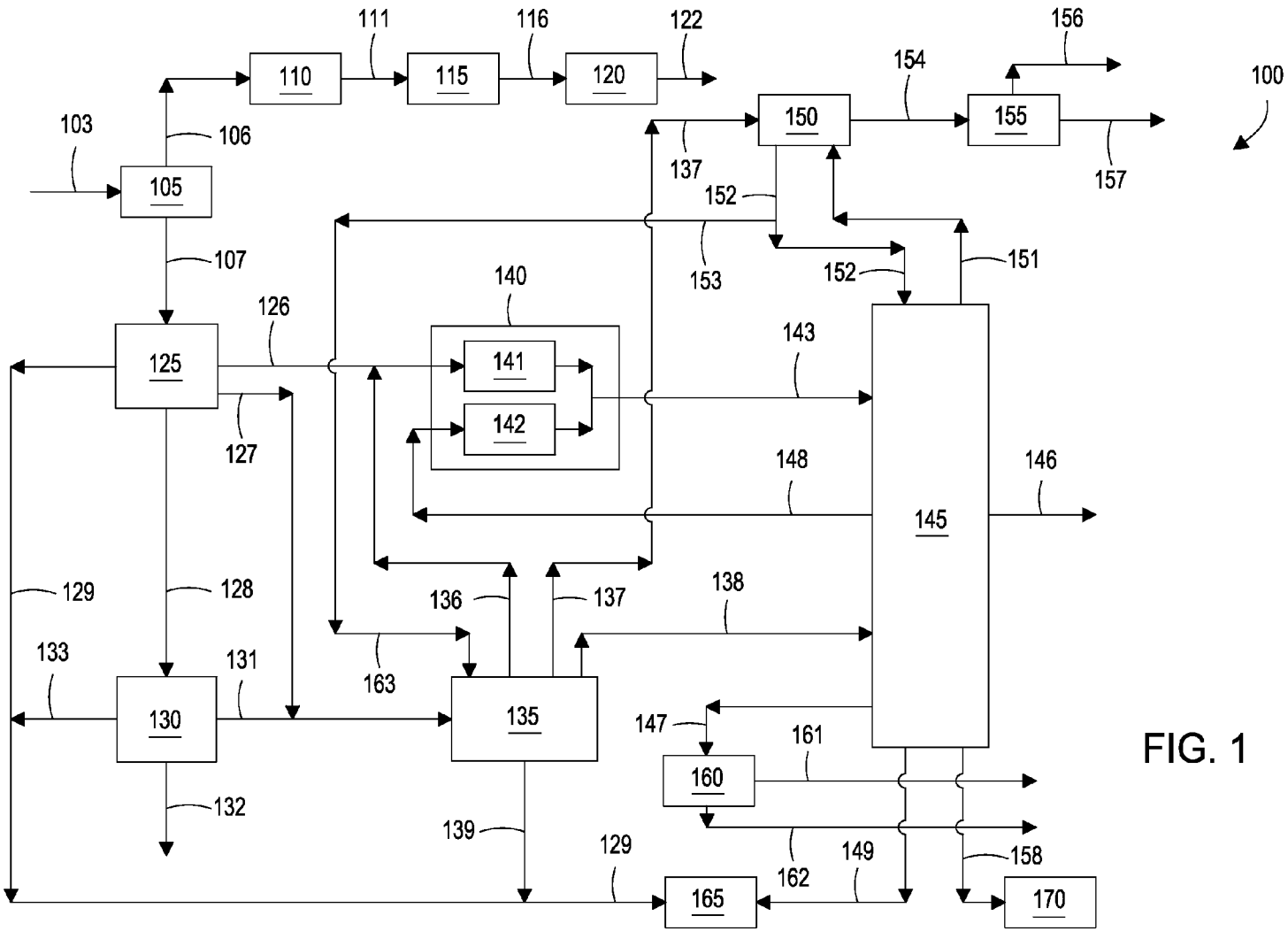
FIG. 1 depicts an illustrative system for upgrading residues according to one or more embodiments described.

FIG. 1 depicts an illustrative system for upgrading residues according to one or more embodiments. In one or more embodiments, the system 100 can include one or more topping towers 105, hydrotreating units 110, reformers 115, and BTX units 120. In one or more embodiments, the system 100 can further include one or more distillation units 125, deasphalting units 130, hydroprocessing units 135, and cracking units 140. In one or more embodiments, the system 100 can further include one or more recovery units 145, amine regeneration units 150, treatment units 155, gasoline hydrotreating units 160, sour water strippers 165, and/or caustic incinerators 170.

A hydrocarbon via line 103 can be introduced to the one or more topping towers 105. The topping tower 105 can separate the hydrocarbon into a naphtha product via line 106 and a residue product via line 107. The naphtha product via line 106 can be introduced to the hydrotreater 110 to provide a hydrotreated naphtha product via line 111. The hydrotreated naphtha product can be introduced to the one or more reformers 115 to provide a reformed naphtha product via line 116. The reformed naphtha product via line 116 can be introduced to the one or more BTX units 120 to provide a BTX product via line 122.

In one or more embodiments, the hydrocarbon in line 103 can be, but is not limited to, one or more carbon-containing materials. The carbon-containing materials can include but are not limited to whole crude oil, crude oil, oil shales, oil sands, tars, bitumens, kerogen, derivatives thereof, or mixtures thereof. In one or more embodiments, the hydrocarbon in line 103 can be or include one or more asphaltenes. In one or more embodiments, the hydrocarbon via line 103 can include one or more asphaltenes and one or more non-asphaltene hydrocarbons.

In one or more embodiments, the hydrocarbon via line 103 can include one more hydrocarbons, having an API@15.6° C. (ASTM D4052) of less than 35, less than 25, less than 20, less than 15, or less than 10. In one or more embodiments, the API can range from a low of about 6, 8, or 10 to a high of about 15, 25, or 30. In one or more embodiments, the hydrocarbon in line 103 can include one or more hydrocarbons having a normal, atmospheric, boiling point of less than about 1,090° C., less than about 1,080° C., less than about 1,050° C., or less than about 1,000° C.

In one or more embodiments, the hydrocarbon in line 103 can have a Conradson Carbon Residue ("CCR") of from about 7% wt to about 17% wt, from about 9% wt to about 15% wt, or from about 11% wt to about 13% wt. For example, the hydrocarbon via line 103 can have a CCR of about 11.7% wt.

In one or more embodiments, the hydrocarbon in line 103 can include about 5% vol to about 25% vol naphthenes, or from about 10% vol to about 20% vol naphthenes, or from about 13% vol to about 18% vol naphthenes. The hydrocarbon in line 103 can include about 5% vol to about 25% vol aromatic hydrocarbons, or from about 10% vol to about 20% vol aromatic hydrocarbons, or from about 13% vol to about 18% vol aromatic hydrocarbons. The hydrocarbon in line 103 can include about 50% vol to about 85% vol paraffins, or from about 60% vol to about 75% vol paraffins, or from about 63% vol to about 70% vol paraffins. The hydrocarbon in line 103 can include from about 25 ppmw to about 400 ppmw or more nickel and from about 200 ppmw to about 1,000 ppmw or more vanadium.

In one or more embodiments, the residue via line 107 can be introduced to the one or more distillation units 125, which can provide a distillate or light distillate via line 126, a gas oil or heavy distillate via line 127, a residue via line 128, and sour water via line 129. The distillate can have a boiling point of less than about 274° C. The gas oil can have a boiling point from about 274° C. to about 343° C. The residue can have a boiling point greater than about 343° C.

In one or more embodiments, the one or more distillation units 125 can be designed to process 100,000 BPSD, 120,000 BPSD, 150,000 BPSD, 175,000 BPSD, 200,000 BPSD or more topped crude. In one or more embodiments, the one or more distillation units 125 can include any system or device suitable for distilling or separating two or more hydrocarbons or groups of hydrocarbons. In one or more embodiments, the one or more distillation units 125 can be a vacuum distillation unit or an atmospheric distillation unit. The one or more distillation units 125 can include one or more crude preheat exchangers, a furnace, a crude fractionator, and a gas oil stripper.

The residue via line 128 can be introduced to the deasphalting unit 130. The deasphalting unit 130 can extract or separate high quality deasphalted oil ("DAO") from the residue to provide a DAO product via line 131 and an asphaltene product via line 132. The DAO can be non-asphaltenic hydrocarbons. The non-asphaltenic hydrocarbons can be a hydrocarbon or mixture of hydrocarbons that are soluble in n-alkanes, yet are totally or partially insoluble in aromatics such as benzene or toluene.

In one or more embodiments, the deasphalting unit 130 can be any system suitable for the separation of asphaltenes from a hydrocarbon. For example, the deasphalting unit 130 can selectively separate the DAO product from the residue with a solvent. In one or more embodiments, the extraction unit 130 can operate at sub-critical, critical, or supercritical temperatures and/or pressures with respect to the solvent to permit separation of the asphaltenes from the oil.

In one or more embodiments, the solvent can be or include any solvent that can differentiate the density of the non-asphaltene hydrocarbons and the asphaltenes to facilitate a phase separation therebetween. Suitable solvents can include, but are not limited to, aliphatic hydrocarbons, cycloaliphatic hydrocarbons, aromatic hydrocarbons, and mixtures thereof. In one or more embodiments, the solvent can include propane, butane, pentane, benzene, or mixtures thereof. In one or more embodiments, the solvent can include at least 90% wt, at least 95% wt, or at least 99% wt of one or more hydrocarbons having a normal boiling point below 538° C. In one or more embodiments, the solvent can include one or more gas condensates having a boiling range of about 27° C. to about 121° C., one or more light naphthas having a boiling range of about 32° C. to about 82° C., one or more heavy naphthas having a boiling range of about 82° C. to about 221° C., or mixtures thereof. In one or more embodiments, the solvent can be or include alkanes having between three and five ($C_3$-$C_5$) carbon atoms. In one or more embodiments, the solvent can include 80% wt or more propane, butanes, pentanes, or mixtures thereof. In one or more embodiments, the solvent can include field butane. In one or more embodiments, the solvent can include a mixture of normal butane and iso-butane, for example, the solvent can be about 70% vol normal butane and about 30% vol iso-butane.

Operating temperature, solvent composition, solvent-to-oil ratio, and, to a lesser extent, pressure in the asphaltene separator can affect product yield and quality. In one or more embodiments, certain process parameters, e.g., total solvent-to-oil ratio, solvent composition, and operating pressure, can be fixed or set at relatively constant values, therefore, the operating temperature of the deasphalting unit 130 can be used as the primary performance control variable.

The DAO yield can be effectively controlled by the deasphalting unit 130 operating temperature. Higher operating temperatures result in less DAO product extracted overhead. Lower operating temperatures produce more DAO, but of a poorer quality. In one or more embodiments, a solvent cooler can control the operating temperature of the deasphalting unit 130, thereby controlling the DAO yield recovered via line 131.

In one or more embodiments, the solvent can have a critical temperature of about 90° C. to about 538° C., about 90° C. to about 400° C., or about 90° C. to about 300° C. In one or more embodiments, the solvent can have a critical pressure of about 2,000 kPa to about 6,000 kPa, about 2,300 kPa to about 5,800, or about 2,600 kPa to about 5,600 kPa. In one or more embodiments, the solvent can be partially or completely vaporized. In one or more embodiments, the solvent can be more than about 50% wt vapor, more than about 75% wt vapor, more than about 90% wt vapor, or more than about 95% wt vapor with the balance being liquid solvent.

In one or more embodiments, the solvent to atmospheric residue ratio can be about 1:1 to about 100:1, about 2:1 to about 10:1, or about 3:1 to about 6:1. The concentration of the solvent can range from about 50% wt to about 99% wt, 60% wt to about 95% wt, or about 66% wt to about 86% wt with the balance the residue. The concentration of the hydrocarbon can range from about 1% wt to about 50% wt, from about 5% wt to about 40% wt, or from about 14% wt to about 34% wt with the balance being solvent.

Asphaltenes can be produced as a byproduct. The asphaltene product can be used as a blend component in the production of some grades of asphalt cement, fuel oil, or solid fuel. The asphaltenes can be further processed by visbreaking, coking, and/or partial oxidation to recover additional hydrocarbon products. The asphaltenes can also be gasified and used for example, to generate power and hydrogen. Water via line 133 recovered from the deasphalting unit 130 can be introduced to the sour water in line 129, which can be introduced to the sour water stripper 165 for further processing and cleanup.

The term "asphaltenes" as used herein refers to a hydrocarbon or mixture of hydrocarbons that are insoluble in n-alkanes such as n-heptane or n-pentane, yet are totally or partially soluble in aromatics such as benzene or toluene. Hydrocarbons that can be classified as asphaltenes include a broad distribution of molecular structures that can vary greatly from one hydrocarbon source to another.

In one or more embodiments, the asphaltenes can have an API@15.6° C. (ASTM D-287) of less than 5, less than 2, less than 0, less than −2, or less than −5. In one or more embodiments, the asphaltenes can have an API@15.6° C. (ASTM D-287) of from about −9 to about 9, or from about −7 to about −3, or from about −6 to about −5. In one or more embodiments, the asphaltenes can have a specific gravity at 15.6° C. of from about 1.007 to about 1.155, or from about 1.037 to about 1.149, or from about 1.068 to about 1.149.

In one or more embodiments, the asphaltenes can include from about 25% wt to about 45% wt CCR, or from about 35% wt to about 41% wt CCR, or from about 37% wt to about 39% wt CCR. In one or more embodiments, the asphaltenes can include about 100 ppm by wt ("ppmw") nickel or more, or about 120 ppmw nickel or more, or about 140 ppmw nickel or more, or about 180 ppmw nickel or more, or about 220 ppmw nickel or more. In one or more embodiments, the asphaltenes can include about 400 ppmw vanadium or more, or about 500 ppmw vanadium or more, or about 600 ppmw vanadium or more, or about 700 ppmw vanadium or more. In one or more embodiments, the asphaltenes can include about 0.5% wt Nitrogen ($N_2$) or more, about 0.8% wt $N_2$ or more, about 1.0% wt $N_2$ or more, or about 1.1% wt $N_2$ or more. In one or more embodiments, the asphaltenes can include about 1.8% wt Sulfur or more, about 2.2% wt Sulfur or more, about 2.5% wt Sulfur or more, or about 2.7% wt Sulfur or more.

In one or more embodiments, the asphaltenes can have a carbon to hydrogen (C:H) ratio of from about 1:1, about 1:1.1, about 1:1.2, about 1:1.3, or about 1:1.4. In one or more embodiments, the asphaltenes can include about 1% to about 30% of the solvent or from about 5% to about 20% of the solvent. In one or more embodiments, the asphaltenes can include from about 10% to about 20% of the total solvent introduced to the one or more mixers 15. The asphaltenes can have a heating value of about 7,000 Kcal/kg or more, or about 8,000 Kcal/kg or more, or about 9,500 Kcal/kg or more, or about 10,000 Kcal/kg or more.

In one or more embodiments, the DAO in line 131 can have an API@15.6° C. (ASTM D-287) of from about 10 to about 20, or from about 12 to about 18, or from about 15 to about 17. In one or more embodiments, the DAO product can contain less than about 50 ppmw vanadium, less than about 35 ppmw vanadium, less than about 25 ppmw vanadium, or less than about 20 ppmw, vanadium. In one or more embodiments, the DAO product can contain less than about 40 ppmw nickel, less than about 20 ppmw nickel, less than bout 15 ppmw nickel, less than about 10 ppmw nickel, or less than about 8 ppmw nickel. In one or more embodiments, the DAO product can contain less than about 15% CCR, less than about 12% CCR, less than about 8% CCR or less than about 5.2% CCR.

In one or more embodiments, the DAO via line 131 can be introduced to the hydroprocessing unit 135. In one or more embodiments, the heavy distillate via line 127 can be introduced to the DAO in line 131 or independently (not shown) to the hydroprocessing unit 135. The hydroprocessing unit 135 can be any suitable hydroprocessing system, device, or combination of systems and/or devices. For example, the hydroprocessing unit 135 can include, but is not limited to hydrodesulfurization, hydrotreating, hydrocracking, hydrogenation of aromatics, hydroisomerization, hydrodewaxing, metal removal, ammonia removal, and the like. In one or more embodiments, the hydroprocessing unit 135 can reduce the sulfur content of the DAO and heavy distillate to provide a de-sulfurized or hydrogenated gas oil via line 136. In one or more embodiments, the hydroprocessed gas oil via line 136 can be introduced to the one or more crackers 140.

The hydroprocessing feed, e.g. the gas oil and/or the DAO, can be heated to the required hydroprocessing reactor 135 inlet temperature in a reactor feed heater and introduced to one or more guard beds. The guard beds can be filled with demetallization ("DEMET") catalyst to remove at least a portion of the metals contained in the feed. The demetallization catalyst can include, but is not limited to, nickel, molybdenum, derivatives thereof, or combinations thereof. The effluent from the guard bed can flow to a hydroprocessing reactor.

In one or more embodiments, the one or more hydroprocessing unit 135 reactors can include one or more beds of high activity hydroprocessing catalyst. The catalyst can be used to achieve the desired levels of reduction in sulfur, nitrogen, and CCR in the hydroprocessing unit 135 product in line 136. For example, the hydroprocessing unit 135 can include two parallel hydroprocessing units 135. In one or more embodiments, each hydroprocessing unit 135 can include four beds of high activity hydroprocessing catalyst. The reactions involved are exothermic, causing a temperature rise across each catalyst bed. Treat gas can be injected as a quench medium between catalyst beds to control the average catalyst temperatures and to limit bed outlet temperatures. The average catalyst temperatures can influence the extent of the various reactions that take place.

In one or more embodiments, a separator can provide a three-phase separation, where the aqueous phase can be removed and introduced to the sour water system 165 via line 139. The vapor from the separator drum can be introduced to an amine absorber knockout drum to remove any entrained hydrocarbon liquid and then routed to a high pressure amine absorber. A suitable amine, such as MEA, DEA MDEA, DGA, and/or DIPA can be used as the lean amine in the absorber. The amine solution can be from about 20% wt to about 50% wt amine, for example 35% wt amine. The rich amine from the absorber, containing ammonia ("$NH_3$") and $H_2S$ removed via line 137 from the vapor feed can be introduced to an amine regeneration section 150 for recovery. A tail gas or off gas via line 138 can be introduced to a caustic tower located within the one or more recovery units 145, caustic tower 170, or both for proper treatment before venting to the atmosphere or other use.

In one or more embodiments, a slipstream of recycle gas from the amine absorber knockout drum can be purified in a membrane system. In one or more embodiments, permeate from the membrane system can be mixed with fresh makeup hydrogen and combined with the recycle gas for use as treat gas. The fresh makeup hydrogen can be about 85% vol, 85% vol, 90% vol, or 95% vol or more hydrogen. The balance of the fresh makeup hydrogen can include other light hydrocarbons, for example, methane, ethylene, ethane, propylene, and propane.

As the reactions within the hydroprocessing unit 135 consume hydrogen, make-up hydrogen can be brought in from outside battery limit ("OSBL") to maintain the reactor loop pressure. Hydrogen rich streams from, for example, existing reformers and/or an ethylene plant can provide make-up gas. The make-up gas header pressure can be controlled by the supplier at the source. The makeup gas can be compressed in two parallel four-stage-reciprocating compressors.

In one or more embodiments, the hydroprocessed product or hydroprocessed gas oil in line 136 can have an API@15.6° C. (ASTM D-287) of from about 15 to about 35, from about 20 to about 30, or from about 24 to about 28. The hydrotreated gas oil in line 136 can contain less than about 20 ppmw nickel, less than about 10 ppmw nickel, less than about 5 ppmw nickel, less than about 1 ppmw nickel, or less than about 0.05 ppmw nickel. The hydrotreated gas oil in line 136 can contain less than about 20 ppmw vanadium, less than about 10 ppmw vanadium, less than about 5 ppmw vanadium, less than about 1 ppmw vanadium, or less than about 0.5 ppmw vanadium.

In one or more embodiments, at least a portion of the light distillate via line 126 can be introduced to the one or more crackers 140. In one or more embodiments, the hydroprocessed gas oil in line 136 can be introduced to the one or more crackers 140 with the light distillate in line 126 or independent of the light distillate, not shown.

In one or more embodiments, the crackers 140 can be any system, device, or combination of systems and/or devices suitable for cracking hydrocarbons. For example, one or more of the crackers 140 can be a steam pyrolytic cracker, a hydrocracker, a catalytic cracker, or a fluidized catalytic cracker. A suitable fluidized catalytic cracker ("FCC") can employ any catalyst useful in catalytic cracking including, but not limited to, zeolytic and shape selective zeolytic catalysts. In one or more embodiments, the catalyst-to-hydrocarbon ratio can be from about 5:1 to about 70:1; from about 8:1 to about 25:1; or from about 12:1 to about 18:1.

As shown, the hydroprocessed gas oil and/or light distillate via line 126 can be introduced to the first cracking zone 141 of the one or more crackers 140 to provide a first cracked hydrocarbon or first cracked product. In one or more embodiments, the first cracked hydrocarbon can include, but is not limited to, $C_2$ hydrocarbons, $C_3$ hydrocarbons, $C_4$ hydrocarbons, naphtha, light cycle oil, and slurry oil.

In one or more embodiments, a second hydrocarbon can be introduced via line 148 to the second cracking zone 142 within the one or more crackers 140 as shown, or to a second cracker (not shown) independent of the first cracker 140, to provide a second cracked hydrocarbon or second cracked product. The second hydrocarbon can be or include recycled hydrocarbons from the recovery unit 145. The second hydrocarbon can include, but is not limited to, $C_4$ hydrocarbons and light naphtha. In one or more embodiments, the second cracked hydrocarbon can include, but is not limited to, $C_2$ hydrocarbons, $C_3$ hydrocarbons and $C_4$ hydrocarbons. For example, the second cracked hydrocarbon can include, but is not limited to, ethylene, propylene, and butadiene. In one or more embodiments, the first cracked hydrocarbon can be mixed with the second cracked hydrocarbon to provide a mixed cracked hydrocarbon via line 143. In one or more embodiments, the first cracked hydrocarbon, the second cracked hydrocarbon, or the mixed cracked hydrocarbon can be introduced via line 143 to the one or more recovery units 145.

In one or more embodiments, the cracked hydrocarbons from the one or more crackers 140 can include, but are not limited to, propylene, ethylene, $C_2$ hydrocarbons, $C_3$ hydrocarbons, $C_4$ hydrocarbons, naphtha, light cycle oil, slurry oil, and highly aromatic naphtha. In one or more embodiments, the products can be purified and separated in the recovery unit 145.

In one or more embodiments, the recovery unit 145 can include any system, device, or combination of systems and/or devices suitable for recovering one or more hydrocarbon products. In one or more embodiments, the products introduced via line 143 to the recovery unit 145 can be fractionated and purified using any fractionators, purifiers, columns, gas treatment units, driers, and the like suitable for purifying and separating the various hydrocarbon products. In one or more embodiments, a hydroprocessing unit in the recovery unit 145 can utilize low pressure tower designs and other features, such as high reliability, heat integration with upstream processes, and a simple depropanizer flow scheme. In one or more embodiments, the recovery unit 145 can steam crack one or more hydrocarbons, which can include, but are not limited to ethane, propane, $C_4$ hydrocarbons, and $C_5$ hydrocarbons. The recovery unit 145 can provide increased recovery of olefins while minimizing energy, capital costs, plot area, and flare emissions.

In one or more embodiments, sour water can be recovered via line 149 from the recovery unit 145 and introduced to the sour water strippers 165 for cleanup. In one or more embodiments, sour gases can be recovered via line 151 and introduced to the amine regeneration unit 150 for recovery and fresh amine can be introduced via line 152 to various sections within the recovery unit 145.

In one or more embodiments, the production of ethylene can be increased by introducing ethane to the hydroprocessing unit within the recovery unit 145. In one or more embodiments, the production of propylene can be increased by introducing propane to the hydroprocessing unit within the recovery unit 145. In one or more embodiments, the naphtha, $C_5$ hydrocarbons, BTX, or mixtures thereof can be introduced via line 147 to the gasoline hydrotreating unit 160. The naphtha, $C_5$ hydrocarbons, and/or BTX can be hydroprocessed, depentanized, and introduced to a BTX recovery unit to provide an aromatics product via line 162 and a raffinate product via line 161. The raffinate product can be introduced to the one or more crackers 140 or another cracking furnace, for example a hydroprocessing unit. The hydroprocessing unit can be integrated with the hydroprocessing unit 135, independent, or integrated within the hydrocarbon recovery unit.

In one or more embodiments, the products recovered via line 146 from the recovery unit 145 can include fuel gas, ethylene, ethane, propylene, propane, mixed $C_4$ hydrocarbons, bunker oil, diesel, and naphtha. The purity and other product qualities can be adjusted to meet desired requirements.

In one or more embodiments, the ethylene product can be about 99% vol or more ethylene, about 99.5% vol or more ethylene, or about 99.9% vol or more ethylene. Contaminants, e.g. non-ethylene components in the ethylene product can include less than about 2,000 ppm by volume ("ppmv") methane and ethane, less than about 1,000 ppmv ethane, less than about 100 ppmv $C_3$ and $C_4$ hydrocarbons, less than about 50 ppmv acetylene, less than about 50 ppmv hydrogen, less than about 50 ppmv oxygen, less than about 20 ppmv carbon dioxide, less than about 50 ppmv carbon dioxide, and less than about 50 ppmv water. In at least one specific embodiment the ethylene product can include less than about 1,000 ppmv methane and ethane, less than about 10 ppmv $C_3$ and $C_4$ hydrocarbons, less than about 5 ppmv acetylene, less than about 5 ppmv hydrogen, less than about 5 ppmv oxygen, less than about 2 ppmv carbon monoxide, less than about 5 ppmv carbon dioxide, and less than about 5 ppmv water.

In one or more embodiments, the propylene product can be about 97% vol or more propylene, about 99% vol or more propylene, or about 99.5% vol or more propylene. Contaminants in the propylene product can include less than about 1,000 ppmv ethylene, less than about 1,000 ppmv ethane, less than about 50 ppmv methyl acetylene, less than about 50 ppmv propadiene, less than about 100 ppmv butene and butadiene, less than about 50 ppmv carbon monoxide, less than about 100 ppmv carbon dioxide, less than about 20 ppmv oxygen, less than about 50 ppmv, and less than about 10 ppmv sulfur. In at least one specific embodiment, the propylene product can include less than about 100 ppmv ethylene, less than about 100 ppmv ethane, less than about 5 ppmv methyl acetylene, less than about 5 ppmv propadiene, less than about 10 ppmv butene and butadiene, less than about 5 ppmv carbon monoxide, less than about 10 ppmv carbon dioxide, less than about 2 ppmv oxygen, less than about 5 ppmv, and less than about 1 ppmv sulfur.

In one or more embodiments, the fuel gas can include, but is not limited to, hydrogen, nitrogen, and methane. In one or more embodiments, the naphtha can include, but is not limited to $C_4$ hydrocarbons, methylbutenes, i-pentane, n-pentane, pentenes, cyclopentadiene, pentadiene, other $C_5$ hydrocarbons, $C_6$ olefins, $C_6$ saturates, benzene, toluene, p-xylene, m-xylene, o-xylene, and other $C_7$ and higher hydrocarbons. In one or more embodiments, the bunker oil can have an API@15.6° C. (ASTM D-287) range from a about 11 to about 19, about 13 to about 17, or about 14 to about 16. For example, the bunker oil can have an API 15.6° C. (ASTM D-287) of about 15. The bunker oil can have a boiling point distillation curve which can range from about 135° C. to about 555° C.

In one or more embodiments, at least a portion of the mixed $C_4$ hydrocarbons and/or naphtha can be recycled via line 148 to the one or more crackers 140. Recycling $C_4$ hydrocarbons and naphtha can increase the production of fuel gases. In one or more embodiments, prior to recycle of the naphtha, the naphtha can be separated into a light naphtha product and a heavy naphtha product. The light naphtha product can be recycled with the $C_4$ hydrocarbons via line 148 to the one or more crackers 140. In one or more embodiments, the hydroprocessing unit within the recovery unit 145 can increase the production of fuel gas and ethylene while reducing the production of ethane, propane, mixed $C_4$ hydrocarbons and other products. In one or more embodiments, the system 100 can be configured to produce a maximum yield for a given facility of transportation fuels. Depending upon market conditions, i.e. demand for certain products, the system 100 can be configured to produce an optimum amount of one or more desired products.

In one or more embodiments, various auxiliary systems can be used to support the processing facilities. For example, corrosion/pH control systems, reactor sulfiding systems, and methanol can be used. A pelletizing system can be used to pelletize the asphaltene byproduct recovered via line 132. The amine regeneration unit 150 can receive rich amine via lines 137 and 151 from amine absorbers (not shown), to remove sour gas and provide lean amine to the absorbers via lines 152 and 153. Due to the large amount of sulfur that can be recovered from the process, a treatment unit 155 can be included, which can remove and recover sulfur. Sour gas can be introduced via line 154 to the treatment unit 155. Treated sour gas via line 156 can be vented to the atmosphere and a sulfur product via line 157 can be recovered. The sour water stripper 165 can process sour water collected from the various process sections, for example via lines 129, 139, and 149 to provide a recovered or cleaned water (not shown), which can be used within the process as wash water or introduced to an existing wastewater treatment facility. The caustic incinerator 170 can receive waste via line 158 from various process sections within the one or more recovery units 145 to dispose of the waste.

Figure 2:
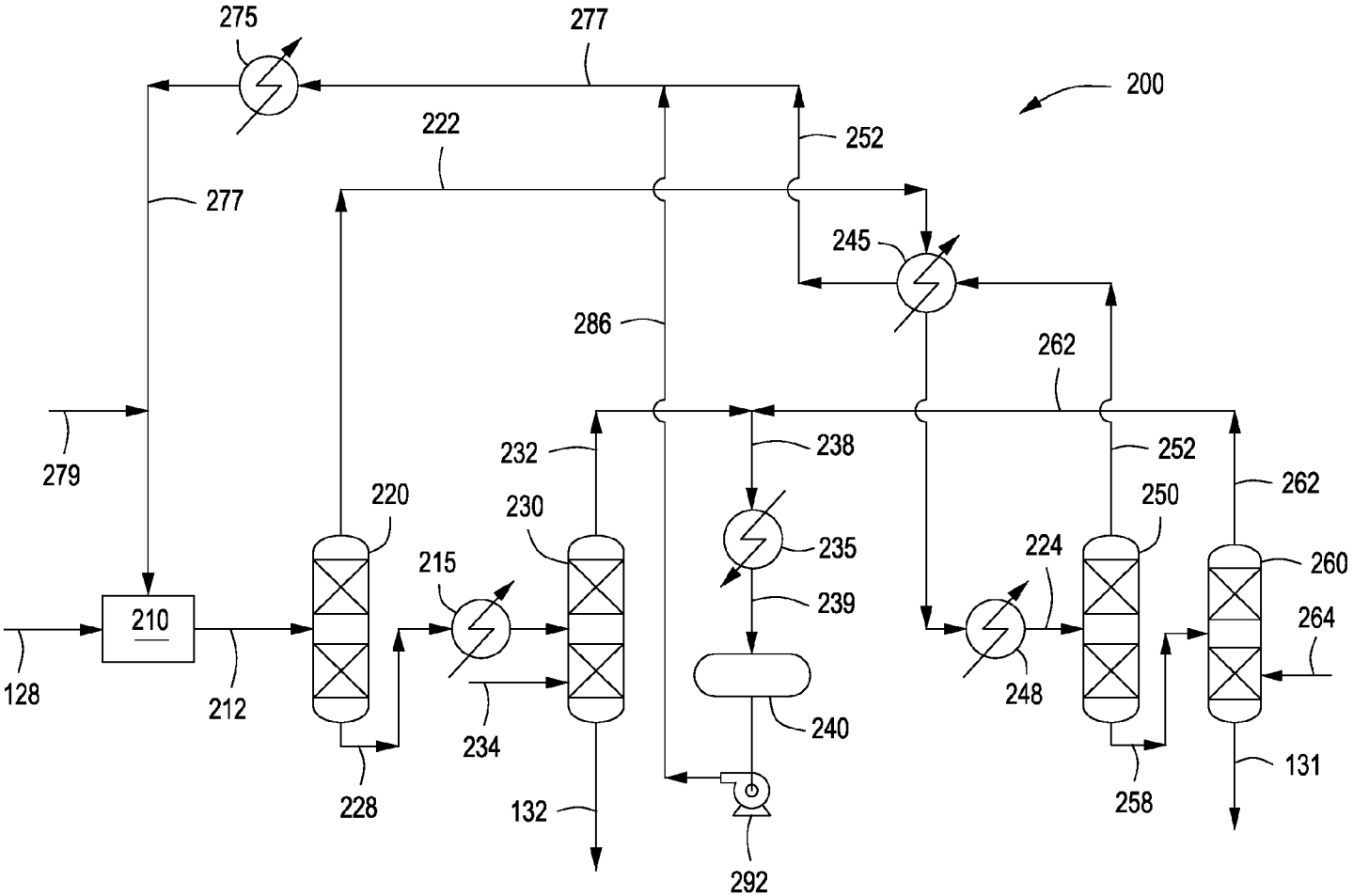
FIG. 2 depicts an illustrative deasphalting system according to one or more embodiments described.

FIG. 2 depicts an illustrative deasphalting system according to one or more embodiments. The deasphalting unit 200 can include one or more mixers 210, separators 220, 250 and strippers 230, 260. Any number of mixers, separators, and strippers can be used depending on the volume of the residue product to be processed.

In one or more embodiments, the residue product via line 128 and the solvent via line 277, with make-up solvent as necessary introduced via line 279, can be mixed or otherwise combined within the one or more mixers 210 to provide a hydrocarbon mixture in line 212. The solvent and the residue product can be as discussed and described above with reference to FIG. 1. The solvent-to-feedstock weight ratio can vary depending upon the physical properties and/or composition of the feedstock. For example, a high boiling point feedstock can require greater dilution with a low boiling point solvent to obtain the desired bulk boiling point for the resultant mixture. The hydrocarbon mixture in line 212 can have a solvent-to-feedstock dilution ratio of about 1:1 to about 100:1; about 2:1 to about 10:1; or about 3:1 to about 6:1.

The one or more mixers 210 can be any device or system suitable for batch, intermittent, and/or continuous mixing of the residue product and solvent. The mixer 210 can be capable of homogenizing immiscible fluids. Illustrative mixers can include but are not limited to ejectors, inline static mixers, inline mechanical/power mixers, homogenizers, or combinations thereof. The mixer 210 can operate at temperatures of from about 25° C. to about 600° C., about 25° C. to about 500° C., or about 25° C. to about 300° C. The mixer 210 can operate at a pressure slightly higher than the pressure of the separator 220. In one or more embodiments, the mixer can operate at a pressure of about 101 kPa to about 700 kPa below or above the critical pressure of the solvent ("$P_{C,S}$"), about $P_{C,S}$−700 kPa to about $P_{C,S}$+700 kPa, or about $P_{C,S}$−300 kPa to about $P_{C,S}$+300 kPa.

The hydrocarbon mixture in line 212 can be introduced to the one or more separators ("asphaltene separators") 220 to provide an overhead via line 222 and a bottoms via line 228. The overhead in line 222 can contain deasphalted oil ("DAO") and a first portion of the one or more solvent(s). The bottoms in line 228 can contain insoluble asphaltenes and the balance of the solvent. In one or more embodiments, the DAO concentration in line 222 can range from about 1% wt to about 50% wt, about 5% wt to about 40% wt, or about 14% wt to about 34% wt. In one or more embodiments, the solvent concentration in line 222 can range from about 50% wt to about 99% wt, about 60% wt to about 95% wt, or about 66% wt to about 86% wt. In one or more embodiments, the density (API@60° F.) of the overhead in line 222 can range from about 10° to about 100°, about 30° to about 100°, or about 50° to about 100°.

In one or more embodiments, the asphaltene concentration in the bottoms in line 228 can range from about 10% wt to about 99% wt, about 30% wt to about 95% wt, or about 50% wt to about 90% wt. In one or more embodiments, the solvent concentration in line 228 can range from about 1% wt to about 90% wt, about 5% wt to about 70% wt, or about 10% wt to about 50% wt.

The one or more separators 220 can be any system or device suitable for separating one or more asphaltenes from the hydrocarbon mixture in line 212 to provide the overhead in line 222 and the bottoms in line 228. In one or more embodiments, the separator 220 can include bubble trays, packing elements such as rings or saddles, structured packing, or combinations thereof. In one or more embodiments, the separator 220 can be an open column without internals. In one or more embodiments, the separators 220 can operate at a temperature of about 15° C. to about 150° C. above the critical temperature of the one or more solvent(s) ("$T_{C,S}$"), about 15° C. to about $T_{C,S}$+100° C., or about 15° C. to about $T_{C,S}$+50° C. In one or more embodiments, the separators 220 can operate at a pressure of about 101 kPa to about 700 kPa above the $P_C$, about $P_{C,S}$−700 kPa to about $P_{C,S}$+700 kPa, or about $P_{C,S}$−300 kPa to about $P_{C,S}$+300 kPa.

In one or more embodiments, the bottoms in line 228 can be heated using one or more heat exchangers 215, and can be introduced to the one or more strippers 230. Within the stripper 230, the bottoms 228 can be selectively separated to provide an overhead via line 232 and an asphaltenic bottoms via line 132. In one or more embodiments, the overhead via line 232 can contain a first portion of one or more solvent(s), and the asphaltenic bottoms in line 132 can contain a mixture of insoluble asphaltenes and the balance of the solvent. In one or more embodiments, steam can be added via line 234 to the stripper 230 to enhance the separation of the one or more solvents from the asphaltenes. In one or more embodiments, the steam in line 234 can be at a pressure ranging from about 200 kPa to about 2,160 kPa, from about 300 kPa to about 1,475 kPa, or from about 400 kPa to about 1,130 kPa. In one or more embodiments, the bottoms in line 228 can be heated to a temperature of about 100° C. to about $T_{C,S}$+150° C., about 150° C. to about $T_{C,S}$+100° C., or about 300° C. to about $T_{C,S}$+50° C. using the one or more heat exchangers 215. In one or more embodiments, the solvent concentration in the overhead in line 232 can range from about 70% wt to about 99% wt, or about 85% wt to about 99% wt. In one or more embodiments, the DAO concentration in the overhead in line 232 can range from about 0% wt to about 50% wt, about 1% wt to about 30% wt, or about 1% wt to about 15% wt.

In one or more embodiments, the solvent concentration in the asphaltenic bottoms in line 132 can range from about 1% wt to about 80% wt, about 10% wt to about 60% wt, or about 15% wt to about 50% wt. In one or more embodiments, the solvent concentration in the asphaltenic bottoms in line 132 can range from a low of about 1%, about 3%, or about 5% to a high of about 10%, about 15%, or about 20%. In one or more embodiments, at least a portion of the asphaltenic bottoms in line 132 can be further processed, e.g. dried and pelletized, to provide a solid hydrocarbon product. In one or more embodiments, at least a portion of the asphaltenic bottoms in line 132 can be subjected to further processing, including but not limited to gasification, power generation, process heating, or combinations thereof. In one or more embodiments, at least a portion of the asphaltenic bottoms in line 132 can be sent to a gasifier to produce steam, power, and hydrogen. In one or more embodiments, at least a portion of the asphaltenic bottoms in line 132 can be used as fuel to produce steam and power.

The one or more heat exchangers 215 can include any system or device suitable for increasing the temperature of the asphaltenic bottoms in line 228. Illustrative heat exchangers, systems or devices can include, but are not limited to, shell-and-tube, plate and frame, or spiral wound heat exchanger designs. In one or more embodiments, a heating medium such as steam, hot oil, hot process fluids, electric resistance heat, hot waste fluids, or combinations thereof can be used to transfer the necessary heat to the asphaltenic bottoms in line 228. In one or more embodiments, the one or more heat exchangers 215 can be a direct fired heater or the equivalent. In one or more embodiments, the one or more heat exchangers 215 can operate at a temperature of about 25° C. to about $T_{C,S}$+150° C., about 25° C. to about $T_{C,S}$+100° C., or about 25° C. to about $T_{C,S}$+50° C. In one or more embodiments, the one or more heat exchangers 215 can operate at a pressure of about 100 kPa to about $P_{C,S}$+700 kPa, about 100 kPa to about $P_{C,S}$+500 kPa, or about 100 kPa to about $P_{C,S}$+300 kPa.

The one or more asphaltene strippers 230 can include any system or device suitable for selectively separating the asphaltenic bottoms in line 228 to provide the overhead in line 232 and the asphaltenic bottoms in line 228. In one or more embodiments, the asphaltene stripper 230 can include, but is not limited to internals such as rings, saddles, balls, irregular sheets, tubes, spirals, trays, baffles, or the like, or any combinations thereof. In one or more embodiments, the asphaltene separator 230 can be an open column without internals. In one or more embodiments, the one or more asphaltene strippers 230 can operate at a temperature of about 30° C. to about 600° C., about 100° C. to about 550° C., or about 300° C. to about 550° C. In one or more embodiments, the one or more asphaltene strippers 230 can operate at a pressure of about 100 kPa to about 4,000 kPa, about 500 kPa to about 3,300 kPa, or about 1,000 kPa to about 2,500 kPa.

The overhead in line 222 can be heated using one or more heat exchangers 245, 248 thereby providing a heated overhead via line 224. In one or more embodiments, the temperature of the heated overhead in line 224 can be increased above the critical temperature of the solvent(s) $T_{C,S}$. In one or more embodiments, the temperature of the heated overhead in line 224 can be increased using one or more heat exchangers 245 and/or 248 to a range from about 25° C. to about $T_{C,S}$+150° C., about $T_{C,S}$−100° C. to about $T_{C,S}$+100° C., or about $T_{C,S}$−50° C. to about $T_{C,S}$+50° C.

The one or more heat exchangers 245, 248 can include any system or device suitable for increasing the temperature of the overhead in line 222. In one or more embodiments, the heat exchanger 245 can be a regenerative type heat exchanger using a heated process stream, for example an overhead via line 252 from the separator 250, to heat the overhead in line 222 prior to introduction to the separator 250. In one or more embodiments, the one or more heat exchangers 245, 248 can operate at a temperature of about 25° C. to about $T_{C,S}$+150° C., about $T_{C,S}$−100° C. to about $T_{C,S}$+100° C., or about $T_{C,S}$−50° C. to about $T_{C,S}$+50° C. In one or more embodiments, the one or more heat exchangers 245, 248 can operate at a pressure of about 100 kPa to about $P_{C,S}$+700 kPa, about 100 kPa to about $P_{C,S}$+500 kPa, or about 100 kPa to about $P_{C,S}$+300 kPa.

The heated overhead in line 224, containing a mixture of the DAO and solvent can be introduced into the one or more separators 250 and selectively separated therein to provide an overhead via line 252 and a bottoms via line 258. In one or more embodiments, the overhead in line 252 can contain a first portion of solvent and the bottoms in line 258 can contain DAO and the balance of the solvent. In one or more embodiments, the solvent concentration in the overhead in line 252 can range from about 50% wt to about 100% wt, about 70% wt to about 99% wt, or about 85% wt to about 99% wt. In one or more embodiments, the DAO concentration in the overhead in line 252 can contain from about 0% wt to about 50% wt, about 1% wt to about 30% wt, or about 1% wt to about 15% wt. In one or more embodiments, the DAO concentration in the overhead in line 252 can range from a low of about 5% wt, about 10% wt, about 15% wt, or about 20% wt to a high of about 30% wt, about 35% wt, about 40% wt, or about 45% wt.

In one or more embodiments, the DAO concentration in the bottoms in line 258 can range from about 20% wt to about 95% wt, about 40% wt to about 80% wt, or about 50% wt to about 75% wt. In one or more embodiments, the DAO concentration in the bottoms in line 258 can range from a low of about 50% wt, about 60% wt, or about 70% wt to a high of about 80% wt, about 90% wt, or about 95% wt. In one or more embodiments, the solvent concentration in the bottoms in line 258 can range from about 1% wt to about 80% wt, about 1% wt to about 60% wt, or about 5% wt to about 40% wt.

The one or more separators 250 can include any system or device suitable for separating DAO from the solvent to provide an overhead in line 252 and the bottoms in line 258. In one or more embodiments, the separator 250 can contain internals such as rings, saddles, structured packing, balls, irregular sheets, tubes, spirals, trays, baffles, or any combinations thereof. In one or more embodiments, the separator 250 can be an open column without internals. In one or more embodiments, the separator 250 can operate at a temperature of about 15° C. to about 600° C., about 15° C. to about 500° C., or about 15° C. to about 400° C. In one or more embodiments, the separators 250 can operate at a pressure of about 101 kPa to about 700 kPa above $P_{C,S}$, about $P_{C,S}$−700 kPa to about $P_{C,S}$+700 kPa, or about $P_{C,S}$−300 kPa to about $P_{C,S}$+300 kPa.

In one or more embodiments, at least a portion of the bottoms in line 258 can be directed to one or more strippers 260 and selectively separated therein to provide an overhead via line 262 and a bottoms or DAO product via line 131. In one or more embodiments, the DAO product in line 131 can be introduced to the one or more hydroprocessing units 135 as discussed and described above with reference to FIG. 1.

In one or more embodiments, the overhead in line 262 can contain a first portion of the one or more solvents, and the bottoms in line 131 can contain DAO and the balance of the one or more solvents. In one or more embodiments, steam can be added via line 264 to the stripper 260 to enhance the separation of the one or more solvents from the DAO. In one or more embodiments, the steam in line 264 can be at a pressure ranging from about 200 kPa to about 2,160 kPa, from about 300 kPa to about 1,475 kPa, or from about 400 kPa to about 1,130 kPa. In one or more embodiments, the solvent concentration in the overhead in line 262 can range from about 70% wt to about 100% wt; about 85% wt to about 99.9% wt; or about 90% wt to about 99.9% wt. In one or more embodiments, the DAO concentration in the overhead in line 262 can contain from about 0% wt to about 30% wt; about 0.1% wt to about 15% wt; or about 0.1% wt to about 10% wt.

In one or more embodiments, the DAO concentration in the bottoms in line 131 can range from about 20% wt to about 100% wt, about 40% wt to about 97% wt, or about 50% wt to about 95% wt. In one or more embodiments, the solvent concentration in the bottoms in line 131 can range from about 0% wt to about 80% wt, about 3% wt to about 60% wt; or about 5% wt to about 50% wt.

The one or more strippers 260 can include any system or device suitable for separating DAO and one or more solvents to provide an overhead via line 262 and the bottoms via line 131. In one or more embodiments, the stripper 260 can contain internals such as rings, saddles, structured packing, balls, irregular sheets, tubes, spirals, trays, baffles, or any combinations thereof. In one or more embodiments, the stripper 260 can be an open column without internals. In one or more embodiments, the stripper 260 can operate at a temperature of about 15° C. to about 600° C., about 15° C. to about 500° C., or about 15° C. to about 400° C. In one or more embodiments, the pressure in the stripper 260 can range from about 100 kPa to about 4,000 kPa, about 500 kPa to about 3,300 kPa, or about 1,000 kPa to about 2,500 kPa.

In one or more embodiments, at least a portion of the one or more solvent overheads in lines 232 and 262 can be combined to provide recycled solvent via line 238. In one or more embodiments, the recycled solvent in line 238 can be a two phase mixture containing both liquid and vapor. In one or more embodiments, the temperature of the recycled solvent in line 238 can range from about 30° C. to about 600° C., about 100° C. to about 550° C., or about 300° C. to about 500° C.

In one or more embodiments, the recycled solvent in line 238 can be condensed using the one or more condensers 235, thereby providing one or more cooled solvents in line 239. In one or more embodiments, the cooled solvent in line 239 can have a temperature of about 10° C. to about 400° C., about 25° C. to about 200° C., or about 30° C. to about 100° C. The solvent concentration in line 239 can range from about 80% wt to about 100% wt, about 90% wt to about 99% wt, or about 95% wt to about 99% wt.

The one or more condensers 235 can include any system or device suitable for decreasing the temperature of the recycled solvents in line 238 to provide a condensed solvent via line 239. In one or more embodiments, condenser 235 can include, but is not limited to liquid or air cooled shell-and-tube, plate and frame, fin-fan, or spiral wound cooler designs. In one or more embodiments, a cooling medium such as water, refrigerant, air, or combinations thereof can be used to remove the necessary heat from the recycled solvents in line 238. In one or more embodiments, the one or more condensers 235 can operate at a temperature of about −20° C. to about $T_{C,S}$° C., about −10° C. to about 300° C., or about 0° C. to about 300° C. In one or more embodiments, the one or more condensers 235 can operate at a pressure of about 100 kPa to about $P_{C,S}$+700 kPa, or about 100 kPa to about $P_{C,S}$+500 kPa, or about 100 kPa to about $P_{C,S}$+300 kPa.

At least a portion of the condensed solvent in line 239 can be stored in the one or more accumulators 240. At least a portion of the solvent in the accumulator 240 can be recycled via line 286 using one or more pumps 292. The recycled solvent in line 286 can be combined with at least a portion of the solvent overhead in line 252 to provide a solvent recycle via line 277. A first portion of the recycled solvent in line 277 can be recycled to the mixer 210 in the solvent deasphalting unit 130.

The temperature of the recycled solvent in line 277 can be adjusted by passing the appropriate heating or cooling media through one or more heat exchangers 275. In one or more embodiments, the temperature of the solvent in line 277 can range from about 10° C. to about 400° C., about 25° C. to about 200° C., or about 30° C. to about 100° C. The solvent concentration in line 277 can range from about 80% wt to about 100% wt, about 90% wt to about 99% wt, or about 95% wt to about 99.9% wt.

The one or more heat exchangers 275 can include, but is not limited to liquid or air cooled shell-and-tube, plate and frame, fin-fan, or spiral wound cooler designs. In one or more embodiments, the one or more heat exchangers 275 can operate at a temperature of about −20° C. to about $T_{C,S}$° C., about −10° C. to about 300° C., or about 0° C. to about 300° C. In one or more embodiments, the one or more condensers 235 can operate at a pressure of about 100 kPa to about $P_{C,S}$+700 kPa, or about 100 kPa to about $P_{C,S}$+500 kPa, or about 100 kPa to about $P_{C,S}$+300 kPa.

Figure 3:
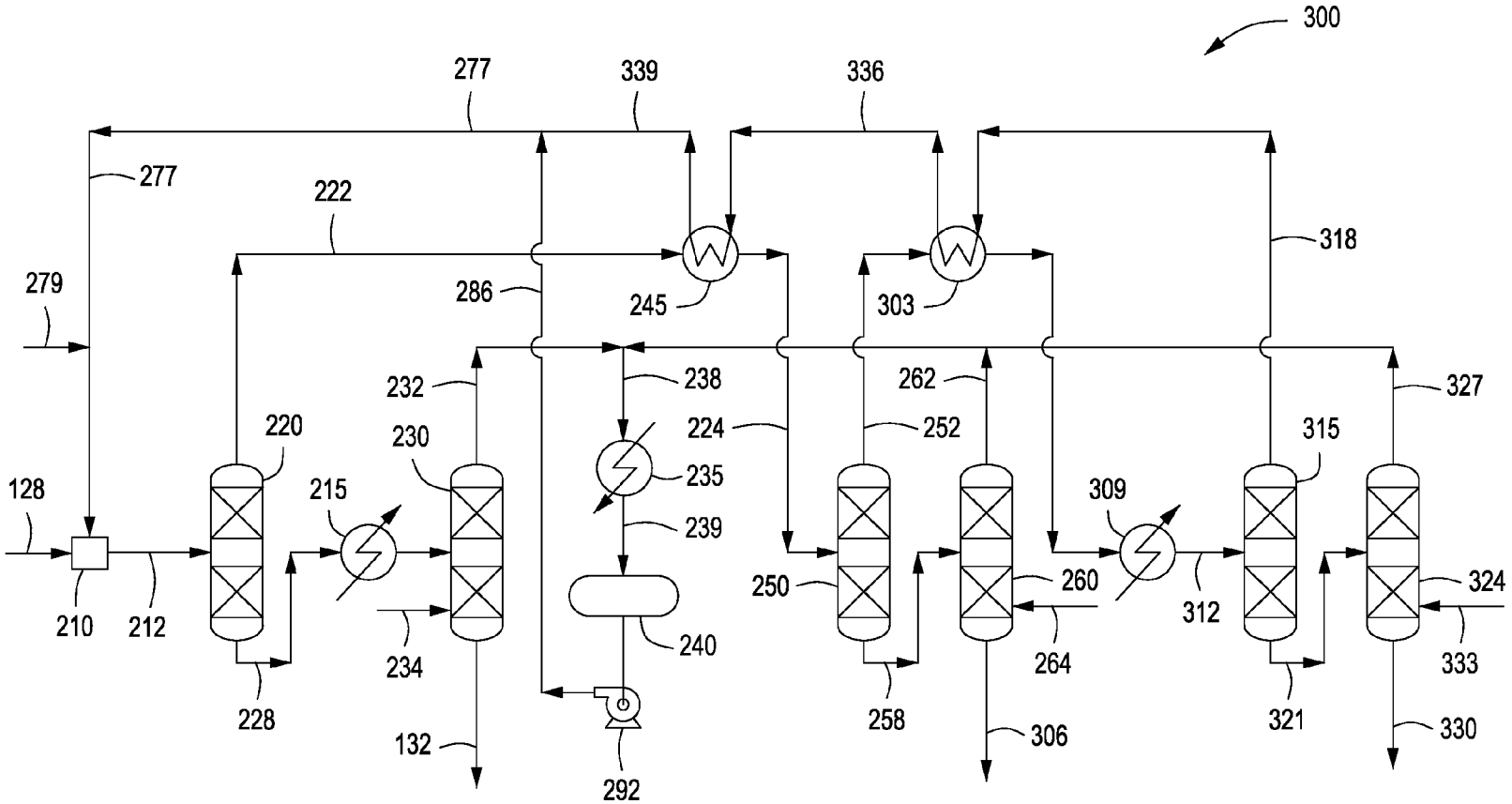
FIG. 3 depicts another illustrative deasphalting system according to one or more embodiments described.

FIG. 3 depicts another illustrative deasphalting system according to one or more embodiments. In addition to the system shown and described above with reference to FIG. 2, the extraction system 300 can further include one or more separators 315 and strippers 324 for the selective separation of the DAO overhead 222 into a heavy deasphalted oil ("resin") fraction via line 306 and a light deasphalted oil fraction via line 330. The solvent and the residue product can be as discussed and described above with reference to FIGS. 1 and 2.

The term "light deasphalted oil" ("light-DAO") as used herein refers to a hydrocarbon or mixture of hydrocarbons sharing similar physical properties and containing less than 5%, 4%, 3%, 2% or 1% asphaltenes. In one or more embodiments, the similar physical properties can include a boiling point of about 315° C. to about 610° C., a viscosity of about 40 cSt to about 65 cSt at 50° C., and a flash point of about 130° C. or more.

The term "heavy deasphalted oil" ("heavy-DAO") as used herein refers to a hydrocarbon or mixture of hydrocarbons sharing similar physical properties and containing less than 5%, 4%, 3%, 2% or 1% asphaltenes. In one or more embodiments, the similar physical properties can include a boiling point of about 400° C. to about 800° C., a viscosity of about 50 cSt to about 170 cSt at 50° C., and a flash point of about 150° C. or more.

In one or more embodiments, the temperature of the asphaltene separator overhead in line 222 can be increased using one or more heat exchangers 245 to provide a heated overhead via line 224. The temperature of the heated overhead in line 224 can range from sub-critical to supercritical based upon the critical temperature of the particular solvent. In one or more embodiments, the temperature of the heated overhead in line 224 can be increased above the critical temperature of the solvent in line 224 and introduced to the one or more separators 250 to provide a first phase containing a heavy-DAO fraction and at least a portion of the solvent, and a second phase containing a light-DAO fraction and the balance of the solvent. In one or more embodiments, the temperature of the heated overhead in line 224 can range from about 15° C. to about $T_{C,S}$+150° C., about 15° C. to about $T_{C,S}$+100° C., or about 15° C. to about $T_{C,S}$+50° C.

The light-DAO in the overhead 252 can range from about 1% wt to about 50% wt, about 5% wt to about 40% wt, or about 10% wt to about 30% wt. In one or more embodiments, the solvent concentration in the overhead in line 252 can range from about 50% wt to about 99% wt, about 60% wt to about 95% wt, or about 70% wt to about 90% wt. In one or more embodiments, the overhead in line 252 can contain less than about 20% wt heavy-DAO, less than about 10% wt heavy-DAO, or less than about 5% wt heavy-DAO.

The heavy-DAO concentration in the bottoms 258 can range from about 10% wt to about 90% wt, about 25% wt to about 80% wt, or about 40% wt to about 70% wt. In one or more embodiments, the solvent concentration in the bottoms in line 258 can range from about 10% wt to about 90% wt; about 20% wt to about 75% wt; or about 30% wt to about 60% wt.

The one or more separators 250 can include any system or device suitable for separating the heated overhead in line 224 to provide an overhead via line 252 and a bottoms via line 258. In one or more embodiments, the separator 250 can include one or more multi-staged extractors having alternate segmental baffle trays, packing, perforated trays or the like, or combinations thereof. In one or more embodiments, the separator 250 can be an open column without internals. In one or more embodiments, the temperature in the one or more separators 250 can range from about 15° C. to about $T_{C,S}$+150° C., about 15° C. to about $T_{C,S}$+100° C., or about 15° C. to about $T_{C,S}$+50° C. In one or more embodiments, the pressure in the one or more separators 250 can range from about 100 kPa to about $P_{C,S}$+700 kPa, about $P_{C,S}$−700 kPa to about $P_{C,S}$+700 kPa, or about $P_{C,S}$−300 kPa to about $P_{C,S}$+300 kPa.

The bottoms in line 258, containing heavy-DAO, can be introduced into the one or more strippers 260 and selectively separated therein to provide an overhead, containing solvent, via line 262 and a bottoms or heavy-DAO, via line 306. In one or more embodiments, steam via line 264 can be added to the stripper 260 to enhance the separation of the solvent from the heavy-DAO. The overhead in line 262 can contain a first portion of the solvent, and the bottoms in line 306 can contain heavy-DAO and the balance of the solvent. In one or more embodiments, at least a portion of the bottoms in line 306 can be directed for further processing including, but not limited to, upgrading through hydroprocessing, catalytic cracking, or a combination thereof. For example, the heavy-DAO in line 306 can be introduced to the one or more hydroprocessing units 135 as discussed and described above with reference to FIG. 1. In one or more embodiments, the solvent concentration in the overhead in line 262 can range from about 50% wt to about 100% wt, about 70% wt to about 99% wt, or about 85% wt to about 99% wt. In one or more embodiments, the heavy-DAO concentration in the overhead in line 262 can range from about 0% wt to about 50% wt, about 1% wt to about 30% wt, or about 1% wt to about 15% wt.

In one or more embodiments, the heavy-DAO concentration in the bottoms in line 306 can range from about 20% wt to about 95% wt, about 40% wt to about 80% wt, or about 50% wt to about 75% wt. In one or more embodiments, the solvent concentration in the bottoms in line 306 can range from about 5% wt to about 80% wt, about 20% wt to about 60% wt, or about 25% wt to about 50% wt. In one or more embodiments, the specific gravity (API@15.6° C.) of the bottoms in line 306 can range from about 1° to about 30°; about 5° to about 20°; or about 5° to about 15°.

The one or more strippers 260 can include any system or device suitable for separating the heavy-DAO and solvents present in the bottoms in line 258 to provide an overhead via line 262 and a bottoms via line 306. In one or more embodiments, the stripper 260 can contain internals such as rings, saddles, structured packing, balls, irregular sheets, tubes, spirals, trays, baffles, or any combinations thereof. In one or more embodiments, the stripper 260 can be an open column without internals. In one or more embodiments, the operating temperature of the one or more strippers 260 can range from about 15° C. to about 600° C., about 15° C. to about 500° C., or about 15° C. to about 400° C. In one or more embodiments, the pressure of the one or more strippers 260 can range from about 100 kPa to about 4,000 kPa, about 500 kPa to about 3,300 kPa, or about 1,000 kPa to about 2,500 kPa.

In one or more embodiments, the light-DAO rich overhead in line 252 can be heated using one or more heat exchangers (two are shown 303, 309) to provide a heated overhead in line 312. The temperature of the heated overhead in line 312 can range from about 15° C. to about $T_{C,S}$+150° C., about 15° C. to about $T_{C,S}$+100° C., or about 15° C. to about $T_{C,S}$+50° C.

In one or more embodiments, the temperature from the heat exchangers 303, 309 can range from about 15° C. to about $T_{C,S}$+150° C., about 15° C. to about $T_{C,S}$+100° C., or about 15° C. to about $T_{C,S}$+50° C. The heat exchangers 303, 309 can operate at a pressure of about 100 kPa to about $P_{C,S}$+700 kPa, about 100 kPa to about $P_{C,S}$+500 kPa, or about 100 kPa to about $P_{C,S}$+300 kPa.

In one or more embodiments, the heated overhead in line 312 can be introduced to the one or more separators 315 and selectively separated therein to provide an overhead via line 318 and a bottoms via line 321. The overhead 318 can contain the solvent, and the bottoms 321 can contain a mixture of light-DAO and the balance of the solvent. The solvent concentration in line 318 can range from about 50% wt to about 100% wt, about 70% wt to about 99% wt, or about 85% wt to about 99% wt. In one or more embodiments, the light-DAO concentration in line 312 can range from about 0% wt to about 50% wt, about 1% wt to about 30% wt, or about 1% wt to about 15% wt.

In one or more embodiments, the light-DAO concentration in line 321 can range from about 10% wt to about 90% wt, about 25% wt to about 80% wt, or about 40% wt to about 70% wt. In one or more embodiments, the solvent concentration in line 321 can range from about 10% wt to about 90% wt, about 20% wt to about 75% wt, or about 30% wt to about 60% wt.

The one or more separators 315 can include any system or device suitable for separating the heated overhead in line 312 to provide an overhead containing solvent via line 318 and a light-DAO rich bottoms via line 321. In one or more embodiments, the separator 315 can include one or more multi-staged extractors having alternate segmental baffle trays, packing, structured packing, perforated trays, and combinations thereof. In one or more embodiments, the separator 315 can be an open column without internals. In one or more embodiments, the separators 315 can operate at a temperature of about 15° C. to about $T_{C,S}$+150° C., about 15° C. to about $T_{C,S}$+150° C., or about 15° C. to about $T_{C,S}$+50° C. In one or more embodiments, the separators 315 can operate at a pressure of about 100 kPa to about $P_{C,S}$+700 kPa, about $P_{C,S}$−700 kPa to about $P_{C,S}$+700 kPa, or about $P_{C,S}$−300 kPa to about $P_{C,S}$+300 kPa.

In one or more embodiments, the bottoms, containing light-DAO, in line 321 can be introduced to the one or more strippers 324 and selectively separated therein to provide an overhead via line 327 and a bottoms via line 330. In one or more embodiments, the overhead in line 327 can contain at least a portion of the solvent, and the bottoms in line 330 can contain a mixture of light-DAO and the balance of the solvent. In one or more embodiments, steam via line 333 can be added to the stripper to enhance the separation of the one or more solvents from the light-DAO. In one or more embodiments, at least a portion of the light-DAO in line 330 can be directed for further processing including, but not limited to hydroprocessing in the one or more hydroprocessing units 135 as discussed and described above with reference to FIG. 1. In one or more embodiments, at least a portion of the light-DAO in line 330 can be introduced to the first reactor-riser 141 and/or the second reactor riser 142 (see FIG. 1.) The light-DAO can be mixed with the recycle hydrocarbons in line 148 (see FIG. 1) and introduced to the second reactor riser 142. In one or more embodiments, the solvent concentration in the overhead in line 327 can range from about 50% wt to about 100% wt, about 70% wt to about 99% wt, or about 85% wt to about 99% wt. In one or more embodiments, the light-DAO concentration in line 327 can range from about 0% wt to about 50% wt, about 1% wt to about 30% wt, or about 1% wt to about 15% wt.

In one or more embodiments, the light-DAO concentration in the bottoms in line 330 can range from about 20% wt to about 95% wt, about 40% wt to about 90% wt, or about 50% wt to about 85% wt. In one or more specific embodiments, the light-DAO concentration in the bottoms in line 330 can be as high as 100% wt. In one or more embodiments, the solvent concentration in line 330 can range from about 5% wt to about 80% wt, about 10% wt to about 60% wt, or about 15% wt to about 50% wt. In one or more embodiments, the specific gravity (API@15.6° C.) of the bottoms in line 330 can range from about 10° to about 60°, about 20° to about 50°, or about 25° to about 45°.

In one or more embodiments, the one or more strippers 324 can contain internals such as rings, saddles, structured packing, balls, irregular sheets, tubes, spirals, trays, baffles, or any combinations thereof. In one or more embodiments, the stripper 324 can be an open column without internals. In one or more embodiments, the one or more strippers 324 can operate at a temperature of about 15° C. to about $T_{C,S}$+150° C., about 15° C. to about $T_{C,S}$+150° C., or about 15° C. to about $T_{C,S}$+50° C. In one or more embodiments, the one or more strippers 324 can operate at a pressure of about 100 kPa to about $P_{C,S}$+700 kPa, about $P_{C,S}$−700 kPa to about $P_{C,S}$+700 kPa, or about $P_{C,S}$−300 kPa to about $P_{C,S}$+300 kPa.

In one or more embodiments, at least a portion of the solvent in the overhead in lines 232, 262 and 327 can be combined to provide a combined solvent in the overhead in line 238. In one or more embodiments, the solvent in the combined solvent overhead in line 238 can be present as a two phase liquid/vapor mixture. In one or more embodiments, the combined solvent overhead in line 238 can be fully condensed using one or more condensers 235 to provide a condensed solvent via line 239. In one or more embodiments the condensed solvent in line 239 can be stored or accumulated using one or more accumulators 240. The solvent stored in the one or more accumulators 240 for recycle within the deasphalting unit 130 can be transferred using one or more solvent pumps 292 and recycle line 286.

In one or more embodiments, the combined solvent overhead in line 238 can have a temperature of about 30° C. to about 600° C., about 100° C. to about 550° C., or about 300° C. to about 550° C. In one or more embodiments, the condensed solvent in line 239 can have a temperature of about 10° C. to about 400° C., about 25° C. to about 200° C., or about 30° C. to about 100° C. The solvent concentration in line 239 can range from about 80% wt to about 100% wt, about 90% wt to about 99% wt, or about 95% wt to about 99% wt.

The one or more condensers 235 can include any system or device suitable for decreasing the temperature of the combined solvent overhead in line 238. In one or more embodiments, condenser 235 can include, but is not limited to liquid or air cooled shell-and-tube, plate and frame, fin-fan, or spiral wound cooler designs. In one or more embodiments, a cooling medium such as water, refrigerant, air, or combinations thereof can be used to remove the necessary heat from the combined solvent overhead in line 238. In one or more embodiments, the one or more condensers 235 can operate at a temperature of about −20° C. to about $T_{C,S}$° C., about −10° C. to about 300° C., or about 0° C. to about 300° C. In one or more embodiments, the one or more coolers 235 can operate at a pressure of about 100 kPa to about $P_{C,S}$+700 kPa, about 100 kPa to about $P_{C,S}$+500 kPa, or about 100 kPa to about $P_{C,S}$+300 kPa.

In one or more embodiments, at least a portion of the overhead in line 318 can be cooled using one or more heat exchangers 303, and 245 to provide a cooled overhead at a first temperature in line 336 and a cooled overhead at a second and cooler temperature in line 339. In one or more embodiments, at least a portion of the cooled overhead in line 339 can be combined with at least a portion of the solvent in line 286 and recycled to the one or more mixers 210 in the deasphalting unit 300 via line 277. In one or more embodiments, about 1% wt to about 95% wt, about 5% wt to about 55% wt, or about 1% wt to about 25% wt of the overhead in line 318 can be cooled using one or more heat exchangers 303, 245. Recycling at least a portion of the solvent to either the solvent deasphalting process depicted in FIG. 3 and/or the solvent deasphalting process depicted in FIG. 2 can decrease the quantity of fresh solvent make-up required, which can be introduced via line 279. In one or more embodiments, prior to introduction to the one or more heat exchangers 303, the overhead in line 318 can be at a temperature of about 25° C. to about $T_{C,S}$, about 150° C. to about $T_{C,S}$, or about 200° C. to about $T_{C,S}$. In one or more embodiments, after exiting the one or more heat exchangers 303, 245, the temperature of the cooled overhead in line 339 can range from about 25° C. to about 400° C., about 50° C. to about 300° C., or about 100° C. to about 250° C.

Figure 4:
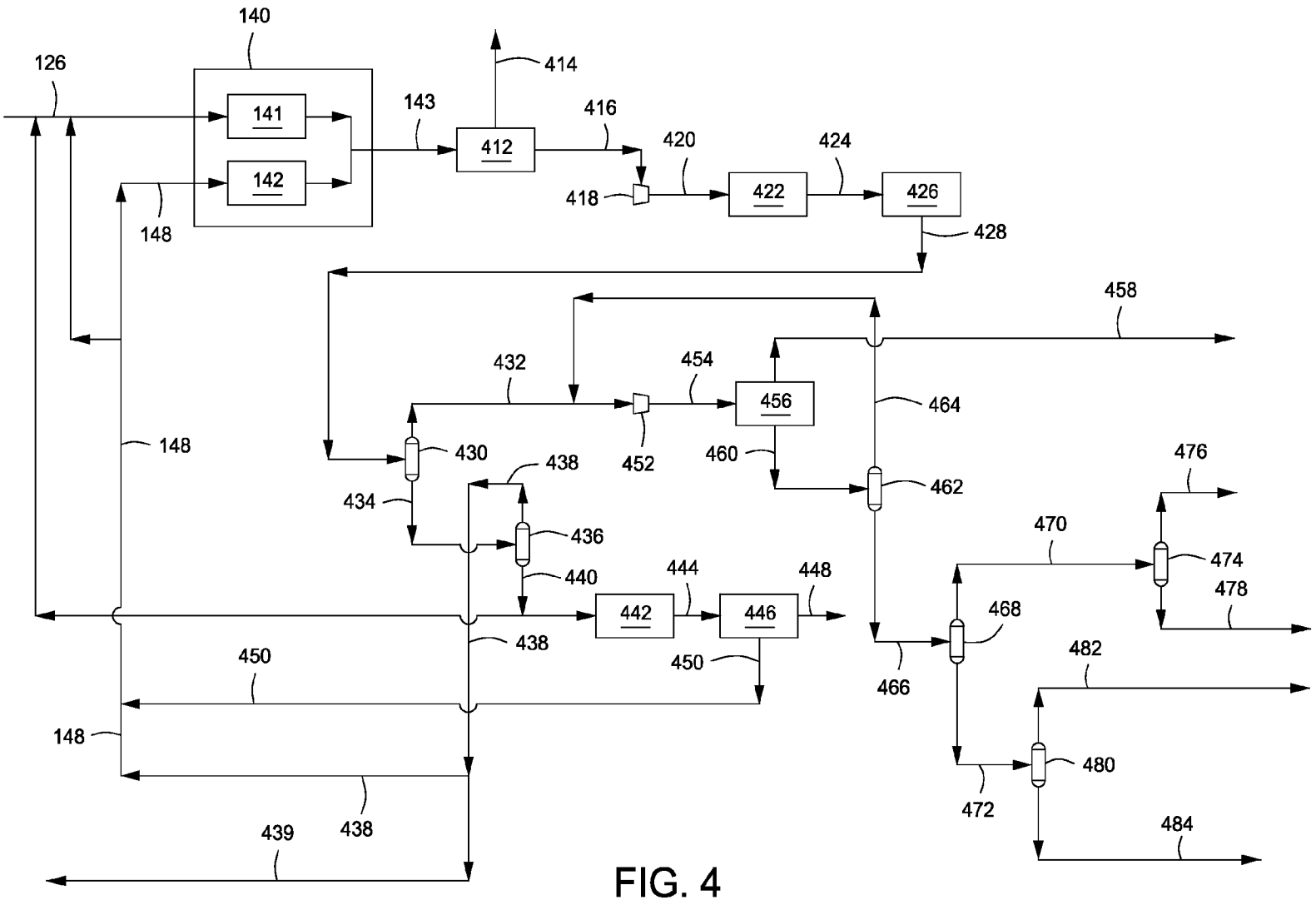
FIG. 4 depicts an illustrative system for producing one or more olefins according to one or more embodiments described.

FIG. 4 depicts an illustrative system for producing one or more olefins according to one or more embodiments. In one or more embodiments, one or more crackers 140 can each include two or more risers or cracking zones 141, 142 independently operated at conditions sufficient to crack or selectively separate different feeds or cuts into one or more olefins. The hydrocarbons in lines 126 and 148 can be as discussed and described above with reference to FIGS. 1-3. The hydrogenated gas oil and light distillate via line 126 can be introduced to the first reactor or first reaction zone 141. The recycled mixed $C_4$ hydrocarbons and/or naphtha via line 148 can be introduced to the second riser 142.

In one or more embodiments, the one or more crackers 140 can be a catalytic cracker, e.g. an FCC. For purposes of discussion, an FCC can be divided into four main sections: one or more reactor-risers, one or more catalyst disengagers, one or more spent catalyst strippers, and one or more catalyst regenerators. Continuous or intermittent catalyst circulation can occur from section to section. The FCC 140 can include an in-line regenerator with an internal stripper and disengager vessels. This compact, self supporting design requires a minimum amount of structural steel and plot area. In one or more embodiments, the cracking unit 140 includes a primary and a secondary reactor-riser 141, 142, however the cracking unit 140 can include one reactor-riser or more than two reactor-risers.

The one or more crackers 140 reactor-riser design can include a catalyst standpipe and catalyst slide valve to transfer regenerated catalyst from the regenerator vessel to one or more reactor-risers. From the slide valve, the catalyst flows up the vertical dense phase transfer line toward the oil injection pickup point. The catalyst flowing through this line can be fluidized with steam.

Diesel (light distillates) and gas oil feeds from the one or more upstream crude distillation units 125 and hydroprocessing units 135 (see FIG. 1) can be collected in the cracking unit 140 feed surge drum, introduced to the required feed pressure by a feed pump, and preheated against a pumparound from a main fractionator before being injected into the lower part of the primary reactor-riser 141 through multiple atomizing injection nozzles located around the circumference of the primary riser. Similarly, the secondary riser 142 can use injection nozzles located in the lower part of the riser to inject recycled $C_4$ hydrocarbons and recycled light naphtha via line 148 from the recovery unit 145. The light naphtha can include $C_5$-$C_6$ hydrocarbons with a boiling point of about 150° C. or less, about 125° C. or less, about 100° C. or less, or about 80° C. or less.

In one or more embodiments, the light distillates and hydrogenated gas oil introduced via line 126 to the primary reactor-riser 141 and/or recycled hydrocarbons introduced via line 148 to the secondary riser 142 can be pre-heated prior to introduction. A regenerative heat exchanger using waste process heat can be used to pre-heat the hydrocarbon feeds in lines 126, 148. In one or more embodiments, the temperature of the hydrocarbon feeds in lines 126, 148 can range from about 370° C. to about 790° C., about 425° C. to about 700° C., or about 480° C. to about 700° C. In one or more embodiments, the pressure of the hydrocarbon feeds in lines 126, 148 can range from about 100 kPa to about 3,450 kPa, about 100 kPa to about 2,750 kPa, or about 100 kPa to about 350 kPa.

In one or more embodiments, LP steam, MP steam, or HP steam can be used in both reactor-risers to aid hydrocarbon atomization in the spray nozzles. The hot regenerated catalyst can vaporize the hydrocarbon feed, raise the hydrocarbon feed to reaction temperature, and supply the necessary heat for cracking. The cracking reaction proceeds as the catalyst and vapor mixture flows through the risers. Each reactor-riser can include an outlet temperature controller to regulate the amount of catalyst admitted into the reactor-riser. Each riser temperature controller can adjust a catalyst slide valve thereby regulating the catalyst flow.

In one or more embodiments, the hydrocarbon feed introduced via line 126 and/or the recycled hydrocarbons introduced via line 148 to the one or more crackers 140 can be partially or completely vaporized prior to introduction. In one or more embodiments, the hydrocarbon feeds via lines 126 and/or 148 can be about 10 vol % to about 100 vol %; about 20 vol % to about 60 vol %; about 30 vol % to about 60 vol %; about 40 vol % to about 60 vol %; or about 50 vol % to about 60 vol % vaporized. In one or more embodiments, the hydrocarbon feeds via lines 126 and/or 148 can be at least about 70 vol % to about 100 vol %, about 80 vol % to about 100 vol %, or about 90 vol % to about 100 vol % vaporized. In one or more embodiments, the hydrocarbon feeds via lines 126 and/or 148 can be a minimum of 80% wt vaporized, 85% wt vaporized, 90% wt vaporized, 95% wt vaporized, or about 99% wt vaporized prior to introduction to the risers 141, 142. In one or more embodiments, within the risers 141, 142 the pressure and temperature can be adjusted either manually or automatically to compensate for variations in hydrocarbon feed composition and to maximize the yield of preferred hydrocarbons obtained by cracking the hydrocarbon feed in the presence of the one or more doped catalysts.

The primary reactor-riser 141 can convert the light distillates and hydrogenated gas oil in line 126 to provide moderate levels of $C_3$ and $C_4$ olefins plus other FCC fuels, such as naphtha, light cycle oil, and slurry oil. The one or more crackers 140 can provide an increased propylene and ethylene yield by cracking recycled $C_4$ hydrocarbons and light naphthas in the secondary riser 142. The propylene yield can range from a low of about 15% wt, about 20% wt, or about 25% wt to a high of about 30% wt, about 35% wt, or about 40% wt. The ethylene yield can range from a low of about 3% wt, about 6% wt, or 9% wt to a high of about 10% wt, about 12% wt, or about 15% wt. For example, the propylene yield can be about 25% wt and the ethylene yield can be about 9% wt (i.e. 34% wt total $C_2$ and $C_3$ hydrocarbons). The ratio of ethylene to propylene production can be adjusted by changing the severity of the secondary reactor-riser as well as by changing the catalyst formulation.

The spent catalyst and cracked hydrocarbon products from each reactor-riser 141, 142 can be introduced into riser (or primary) cyclones for the initial separation. Each reactor-riser 141, 142 can include dedicated multiple cyclones attached directly to the top of the reactor-riser. Each reactor-riser 141, 142 can share one or more cyclones for the separation of spent catalyst and the cracked oil products. Catalyst can be discharged into the catalyst stripper bed through the diplegs while product gases and small quantities of catalyst can discharge into the disengaging vessel. The product gases can then flow into the upper cyclones mounted high in the disengaging vessel. Stripped hydrocarbons and steam from the stripper can enter the upper cyclones which further reduces the catalyst concentration in the product vapors. The reaction vapors can leave the disengager through the upper cyclones and flow to the downstream main fractionator.

Catalyst separated in the cyclones can flow through the respective diplegs and discharges into the stripper. The diplegs of the riser cyclones can be submerged in the stripper bed. The diplegs of the upper cyclones can discharge through trickle valves into the stripper bed.

The catalyst entering the stripper can be contacted by up-flowing steam introduced through two steam distributors. The majority of the hydrocarbon vapors entrained with the catalyst can be displaced by the up-flowing steam. Spent catalyst can flow down through a set of hat and doughnut baffles, for example five hat and doughnut baffles. In the set of hat and doughnut baffles, a combination of residence time and steam partial pressure can be used to allow the hydrocarbons to diffuse out of the catalyst pores into the steam introduced via the lower distributor.

Stripped catalyst, with at least a portion of the strippable hydrocarbons removed, can flow into a single, vertical standpipe, which can be aerated with steam, e.g., LP steam, MP steam, and/or HP steam, to maintain smooth flow. At the base of this standpipe, a plug valve can regulate the flow of catalyst maintaining the spent catalyst level in the stripper. The catalyst then flows into the spent catalyst distributor and into the regenerator.

In the regenerator, coke can be burned off the catalyst to supply the heat requirements of the process and restore the catalyst's activity. The regenerator can be operated in either a full or partial carbon monoxide ("CO") combustion mode as process requirements dictate. Combustion air can be supplied to the regenerator via an air compressor. The combustion products from the burning of the coke can include CO, carbon dioxide ("$CO_2$"), water ("$H_2O$"), and smaller amounts of both sulfur oxides ("SOx") and nitrogen oxides ("NOx"). In the regenerator cyclones, the combustion gases can be separated from the catalyst. The gases can flow into the flue gas system and the catalyst can be returned to the dense bed through the cyclone diplegs. The regeneration system can be designed to reduce residual carbon in the catalyst.

The catalyst inventory within the regenerator does not have to be under direct level control, but can rather depend on the entire unit inventory of the one or more crackers 140.

During normal operation, regenerator pressure control can be attained by throttling the flue gas control valve. The valve position can be controlled by a differential pressure controller system provided between the regenerator and disengager vessels.

Regenerator flue gases can exit the regenerator through two stage high-efficiency cyclones external plenum chamber. The system can be designed to minimize thermal stresses in the cyclone/plenum system by eliminating differential thermal expansion between cyclone elements. From the external plenum, the flue gas can flow through the flue gas slide valve and orifice chamber. The orifice chamber can be designed to reduce the pressure in a series of steps in order to prevent the occurrence of sonic velocity across the flue gas throttling valve. The flue gas from the orifice chamber can flow to a flue gas cooler which can produce superheated steam for use within the processing complex. The flue gas can then pass through an exhaust stack. In some cases, third stage separators or flue gas scrubbers can be included to minimize atmospheric emissions of particulates and sulfur oxides.

Fresh catalyst, catalyst additives, and spent catalyst storage silos can be provided. The fresh catalyst and additive silos can be designed to hold 30 days supply of inventory. The spent catalyst silo can be designed to hold the entire inventory of the converter plus capacity for equilibrium catalyst withdrawals.

Two pumps (batch catalyst loaders) can be provided to semi-continuously or continuously add catalyst and additives, for example, high crystal ZSM-5 additive to the regenerator at controlled rates. The high crystal ZSM-5 catalyst can be commercially purchased from multiple major catalyst vendors, such as Grace and Intercat. In one or more embodiments, the catalyst can include, but is not limited to one or more zeolites, faujasite zeolites, modified faujasite zeolites, Y-type zeolites, ultrastable Y-type zeolites (USY), rare earth exchanged Y-type zeolites (REY), rare earth exchanged ultrastable Y-type zeolites (REUSY), rare earth free Z-21, Socony Mobil #5 zeolite (ZSM-5), or high activity zeolite catalysts. In one or more embodiments, the catalyst-to-hydrocarbon weight ratio can range from about 5:1 to about 70:1; from about 8:1 to about 25:1; or from about 12:1 to about 18:1. In one or more embodiments, the temperature of the catalyst, prior to introduction to the riser 120, can range from about 200° C. to about 815° C.; about 200° C. to about 760° C.; or about 200° C. to about 675° C. A steam ejector can be used to provide a partial vacuum for moving catalyst into the silo from various sources (e.g. delivery trucks).

The effluents from each riser 141, 142 can be combined, to provide a first and second cracked hydrocarbon mixture or cracked mixture via line 143. In one or more embodiments, the hydrocarbon mixture can be fractionated and purified using one or more fractionators 412, purifiers 422, 426 and columns 430, 436, 462, 468, 474, 480 to provide multiple products including propylene, ethylene, propane and ethane. The heavier $C_4$-$C_6$ hydrocarbons, separated from the finished products, can be recycled to the one or more crackers 140 via line 148.

In one or more embodiments, the cracked mixture via line 143 can be introduced to the one or more fractionators 412 and selectively separated therein to provide a naphthenic mixture via line 414 and an olefinic mixture via line 416. In one or more embodiments, the naphthenic mixture can include, but is not limited to light naphthas, heavy naphthas, naphthenic compounds, mixtures thereof, derivatives thereof, or any combination thereof. The olefinic mixture via line 416 can be compressed using one or more compressors 418 to provide a compressed olefinic mixture via line 420, which can be treated using one or more treating units 422 to provide a treated olefinic mixture via line 424. In one or more embodiments, the treated olefinic mixture via line 424 can include less than about 500 ppmv $H_2S$, less than about 50 ppmv $H_2S$, or less than about 1 ppmv $H_2S$. In one or more embodiments, the treated olefinic mixture can include less than about 500 ppmv $CO_2$, less than about 100 ppmv $CO_2$, or less than about 50 ppmv $CO_2$.

The treating unit 422 can include any system or device or combination of systems and/or devices suitable for removing oxygenates, acid gases, water, derivatives thereof, mixtures thereof, which are well known in the art of hydrocarbon refining. For example, the treating unit can include one or ore oxygen removal units and one or more amine and/or caustic towers or systems.

The treated olefinic mixture via line 424 can be introduced to one or more drying units 426 to provide a dried olefinic mixture via line 428. The dried olefinic mixture can include less than 200 ppmv $H_2O$, less than 100 ppmv $H_2O$, less than 50 ppmv $H_2O$, less than 25 ppmv $H_2O$, less than 10 ppmv $H_2O$, or less than 1 ppmv $H_2O$. The drying unit 426 can include any system or device or combination of systems and/or devices suitable for removing water from a hydrocarbon to provide a dried olefinic mixture via line 428. For example, the drying unit 426 can include systems that use desiccants, solvents, or any combination thereof for removing water from a hydrocarbon.

In one or more embodiments, the dried olefinic mixture via line 428 can be introduced to one or more de-propanizers 430 and selectively separated therein to provide an overhead containing $C_3$ and lighter hydrocarbons via line 432, and a bottoms containing $C_4$ and heavier hydrocarbons via line 434. In one or more embodiments, the dried olefinic mixture can be introduced to a liquid coalescer (not shown), which can remove entrained water. In one or more embodiments, both the drying unit 424 and the liquid coalescer can be provided with two dryers, with one operating and the one in regeneration/standby.

The one or more de-propanizers 430 can include any device, system or combination of devices and/or systems suitable for selectively separating the dried olefinic mixture via line 428 to provide an overhead containing $C_3$ and lighter hydrocarbons via line 432, and a bottoms containing $C_4$ and heavier hydrocarbons via line 434. In one or more embodiments, the de-propanizers 430 can include, but is not limited to, a column containing internal components, as well as one or more condensers and/or reboilers. In one or more embodiments, the de-propanizers 430 can include packing media to facilitate the selective separation of $C_3$ and lighter hydrocarbons from the $C_4$ and heavier hydrocarbons. For example, each de-propanizers 430 can include one or more saddles, balls, irregular sheets, tubes, spirals, trays, and/or baffles. In one or more embodiments, the operating pressure of the de-propanizer 430 can range from about 500 kPa to about 2,500 kPa, and the operating temperature of the de-propanizer 430 can range from about −60° C. to about 100° C.

In one or more embodiments, the $C_4$ and heavier hydrocarbons via line 434 can be introduced to one or more gasoline splitters or debutanizers 436 and selectively separated therein to provide an overhead containing $C_4$-$C_6$ hydrocarbons via line 438 and a bottoms containing $C_7$ and heavier hydrocarbons via line 440. In one or more embodiments, the $C_4$ and heavier hydrocarbons via line 434 can be introduced to the one or more gasoline splitters or debutanizers 436 and selectively separated therein to provide an overhead containing $C_4$ hydrocarbons via line 438 and a bottoms containing $C_5$ and heavier hydrocarbons via line 440. In one or more embodiments, the overhead 438 can include butanes and isobutanes. For example, the overhead 438 can include from about 50% wt to about 95% wt butanes. In one or more embodiments, the overhead 438 can include from about 10% wt to about 50% wt isobutanes. In one or more embodiments, the overhead 438 can include from about 10% wt to about 50% wt $C_4$ olefins, from about 5% wt to about 30% wt $C_5$ olefins, and from about 5% wt to about 20% wt $C_6$ olefins.

In one or more embodiments, at least a portion of the $C_4$-$C_6$ hydrocarbons via line 438 can be recycled to the second riser 142 via line 148. In one or more embodiments, at least a portion of the $C_4$-$C_6$ hydrocarbons in line 438 can be recycled to the one or more gasoline hydrotreating units 160 (see FIG. 1) via line 439. For example, about 5% wt, about 15% wt, about 25% wt, about 35% wt, about 45% wt, about 55% wt, or about 65% wt of the $C_4$-$C_6$ hydrocarbons via line 438 can be recycled to the second riser 142 via line 148 with the balance recycled to the one or more gasoline hydrotreating units 160 via line 439. In one or more embodiments, about 10% wt, about 20% wt, about 30% wt, about 40% wt, about 50% wt, about 60% wt, or about 70% wt of the $C_4$-$C_6$ hydrocarbons via line 438 can be recycled to the one or more gasoline hydrotreating units 160 via line 439. In one or more embodiments, about 5% wt, about 15% wt, about 25% wt, or about 35% wt of the $C_4$-$C_6$ hydrocarbons via line 438 can be introduced to the one or more gasoline hydrotreating units 160 via line 439 with the balance recycled to the second riser 142 via line 148.

In one or more embodiments, at least a portion of the $C_4$-$C_6$ hydrocarbons via line 438 can be recycled via line 148 to the first riser 141 and/or the second riser 142. For example, about 10% wt to about 60% wt, about 10% wt to about 35% wt, about 25% wt to about 45% wt, or about 35% wt to about 60% wt of the $C_4$-$C_6$ hydrocarbons via line 148 can be recycled to the first riser 141 with the balance recycled to the second riser 142. In one or more embodiments, from about 25% wt to about 100% wt, 25% wt to about 55% wt, about 45% wt to about 65% wt, about 55% wt to about 85% wt, or about 65% wt to 99% wt of the $C_4$-$C_6$ hydrocarbons via line 148 can be recycled to the first riser 141 with the balance to the second riser 142. Recycling at least a portion of the $C_4$-$C_6$ hydrocarbons via line 438 to the first riser 141 can increase the production of the aromatics, i.e. BTX. Recycling at least a portion of the $C_4$-$C_6$ hydrocarbons via line 438 to the second riser 142 can increase the production of propylene.

In one or more embodiments, all or any portion of the $C_5$ and heavier or all or any portion of the $C_7$ and heavier hydrocarbons via line 440 can be recycled to the first riser 141. In one or more embodiments, about 10% wt to about 20% wt, about 15% wt to about 35% wt, about 30% wt to 55% wt, about 50% wt to about 75% wt, or about 65% wt to about 80% wt of the hydrocarbons via line 440 can be recycled to the first riser 141. Recycling at least a portion of the hydrocarbons can increase the production of ethylene.

The gasoline splitter 436 can include any device, system or combination of devices and/or systems suitable for selectively separating a hydrocarbon mixture to provide the overhead 438 containing the $C_4$-$C_6$ hydrocarbons, and the bottoms 440 containing the $C_5$ and heavier hydrocarbons or the $C_7$ and heavier hydrocarbons. In one or more embodiments, the gasoline splitter 436 can include, but is not limited to, a column containing internal components, as well as one or more condensers and/or reboilers. In one or more embodiments, the gasoline splitter 436 can include packing media to facilitate the selective separation of $C_6$ and lighter hydrocarbons from $C_7$ and heavier hydrocarbons. For example, each gasoline splitter 436 can include saddles, balls, irregular sheets, tubes, spirals, trays, and/or baffles. In one or more embodiments, the operating pressure of the gasoline splitter 436 can range from about 100 kPa to about 2,500 kPa, and temperature can range from about 20° C. to about 400° C.

In one or more embodiments, the $C_5$ and heavier hydrocarbons or the $C_7$ and heavier hydrocarbons via line 440 can be stabilized using one or more gasoline hydrotreaters 442 to provide a treated gasoline via line 444. In one or more embodiments, the treated gasoline via line 444 can include at least about 70% wt, 80% wt, or 90% wt $C_6$ and heavier hydrocarbons. In one or more embodiments, the treated gasoline via line 444 can include about 75% wt to about 85% wt $C_6$, about 15% wt to about 25% wt $C_7$, or about 5% wt to about 10% wt $C_8$ and heavier hydrocarbons. The gasoline hydrotreater 442 can include any system or device or combination of systems and/or devices suitable for stabilizing a mixed hydrocarbon. In one or more embodiments, the hydrotreater 442 can include a system that stabilizes gasoline by treating with hydrogen.

The treated gasoline via line 444 can be selectively separated using one or more BTX units 446 to separate the aromatics via line 448 from a raffinate via line 450. In one or more embodiments, at least a portion of the raffinate via line 450 can be recycled to the second riser 142 via line 148. In one or more embodiments, the raffinate via line 450 can be lean in aromatics. For example, the raffinate in line 450 can include less than about 10% wt, 5% wt, or 1% wt BTX. In one or more embodiments, at least 70% wt, 80% wt, or 90% wt of the raffinate in line 450 can be recycled to the second riser 142 with the balance to the first riser 141. Although not shown in FIG. 4, about 20% wt, about 30% wt, about 40% wt, or about 50% wt of the raffinate via line 450 can be recycled to the first riser 141. In one or more embodiments, about 20% wt, about 30% wt, about 40% wt, or about 50% wt of the raffinate via line 450 can be recycled to the second riser 142 with the balance to the first riser 141. In one or more embodiments, about 70% wt, about 80% wt, or about 90% wt of the raffinate via line 450 can be recycled to the second riser 142 with the balance to the first riser 141. Although not shown, the raffinate via line 450 can be further processed. For example, all or any portion of the raffinate in line 450 can be directed to a steam pyrolytic cracker to recover any olefinic or paraffinic hydrocarbons therein.

Although not shown in FIG. 4 all or any portion of the aromatics via line 448 can be recycled to the first riser 141. For example, about 20% wt, about 40% wt, about 60% wt, about 80% wt, or about 90% wt of the aromatics via line 448 can be recycled to the first riser 141.

Returning to the de-propanizer 430, the $C_3$ and lighter hydrocarbons via line 432 can be compressed using one or more compressors 452. The compressed $C_3$ and lighter hydrocarbons can be compressed to a pressure of about 500 kPa to about 3,500 kPa, for example.

The compressed $C_3$ and lighter hydrocarbons via line 454 can be chilled and separated using one or more chill trains 456 to provide an overhead containing hydrogen and non-condensables via line 458 and a bottoms containing $C_3$ and lighter hydrocarbons via line 460. In one or more embodiments, hydrogen, nitrogen, non-condensable gases, mixtures thereof, or combinations thereof can be removed via line 458. The chilled $C_3$ and lighter hydrocarbons can exit the one or more chill trains 456 via line 460 at temperatures ranging from about −40° C. to about 40° C. In one or more embodiments, the chilled $C_3$ and lighter hydrocarbons can have a temperature from about −20° C. to about 5° C.

In one or more embodiments, the $C_3$ and lighter hydrocarbons via line 458 can be introduced to one or more de-methanizers 462 and selectively separated therein to provide an overhead containing methane via line 464 and a bottoms containing $C_2$ and $C_3$ hydrocarbons via line 466. In one or more embodiments, all or any portion of the methane via line 464 can be recycled to the inlet of the one or more compressors 452. Recycling at least portion of the methane via line 464 can refrigerate the compressed $C_3$ and lighter hydrocarbons in line 432 thereby improving the recovery of olefins and increasing the propylene yield in the converted propylene production process.

The $C_2$ and $C_3$ hydrocarbons via line 466 can be introduced to one or more de-ethanizers 468 and selectively separated therein to provide an overhead containing a $C_2$ hydrocarbon mixture via line 470 and a bottoms containing a $C_3$ hydrocarbon mixture via line 472. In one or more embodiments, the overhead in line 470 can include about 90% mol, 95% mol, or 99% mol $C_2$ hydrocarbon mixture. In one or more embodiments, the $C_2$ hydrocarbon mixture can include from about 5% mol to about 70% mol ethane and from about 30% mol to about 95% mol ethylene. In one or more embodiments, the bottoms 472 can include about 90% mol, 95% mol, or 99% mol $C_3$ hydrocarbon-mixture. In one or more embodiments, the $C_3$ hydrocarbon mixture can include from about 5% mol to about 30% mol propane and from about 70% mol to about 95% mol propylene. In one or more embodiments, the operating pressure of the de-ethanizer 468 can range from about 500 kPa to about 2,500 kPa, and the temperature can range from about −80° C. to about 100° C.

In one or more embodiments, the $C_2$ hydrocarbon mixture via line 470 can be introduced to one or more C2 splitters 474 and selectively separated therein to provide an ethylene product via line 476 and an ethane product via line 478. The ethane product via line 478 can include about 90% mol, 95% mol, or 99% mol ethane. In one or more embodiments, the ethane product can include about 95% mol, 99% mol, or 99.9% mol ethane.

In one or more embodiments, the ethylene product via line 476 can include about 90% mol, 95% mol, or 99% mol ethylene. In one or more embodiments, the ethylene product via line 476 can include at least about 95% mol, 99% mol, or 99.9% mol ethylene. Although not shown, all or any portion of the ethylene product via line 476 can be recycled to the cracker 140. Recycling at least a portion of the ethylene product can suppress propylene production in the one or more crackers 140, thereby increasing the yield of ethylene in the cracked product or cracked mixture via line 143. In one or more embodiments, from about 10% vol to about 60% vol, from about 20% vol to about 60% vol, from about 30% vol to about 60% vol, from about 40% vol to about 60% vol, or from about 50% vol to about 60% vol of the ethylene product via line 476 can be recycled to the one or more crackers 140. In one or more embodiments, from about 60% vol to about 99% vol, from about 70% vol to about 95% vol, or from about 80% vol to about 90% vol of the ethylene product can be recycled to the one or more crackers 140.

The one or more C3 splitters 480 can be used to selectively separate the $C_3$ hydrocarbon mixture via line 472 to provide a propylene product via line 482 and a propane product via line 484. In one or more embodiments, the propane product can contain about 90 mol %, 95% mol, 99% mol, or 99.9% mol propane. In one or more embodiments, the propylene product via line 482 can include from about 60% wt to about 99.9% wt propylene.

The C3 splitter 480 can be any device suitable for selectively separating the $C_3$ hydrocarbon mixture to provide the propylene product via line 482 and the propane product via line 484. In one or more embodiments, the C3 splitter 480 can include, but is not limited to, a column containing internal components, as well as one or more condensers and/or reboilers. In one or more embodiments, the operating pressure of the C3 splitter 480 can range from about 500 kPa to about 2,500 kPa, and the temperature can range from about −100° C. to about 100° C.

EXAMPLE

Embodiments of the present invention can be further described with the following simulated processes. Several simulated processes are provided to show the versatility and improved product yields of the invention. The following simulated results illustrate heat and material balances for certain streams with reference to one or more embodiments depicted in FIGS. 1 through 4.

Table 1 provides an overall material balance of a process configuration tailored to increased olefins production; however, the process can be modified to accommodate changes in market conditions. For example, the process can be operated to generate high quality transportation fuels while lowering olefins production when transportation fuels are desired.

TABLE 1

Simulated Overall Material Balance.

| | RATES MTD |
|---|---|
| External Feed Streams | |
| Crude | 22,055 |
| Hydrogen | 261 |
| Primary Product Streams | |
| Fuel Gas | 1,050 |
| Ethylene | 1,118 |
| Ethane | 313 |
| Propylene | 3,138 |

TABLE 1-continued

| Simulated Overall Material Balance. | |
|---|---|
| | RATES MTD |
| Propane | 834 |
| Mixed C4s | 1,154 |
| Naphtha from Craker | 2,696 |
| Naphtha from Existing Topping Unit | 3,545 |
| Bunker Oil | 1,551 |
| Pitch | 5,526 |
| Sulfur | 256 |
| Coke | 1,130 |

As shown in Table 1, the process is tailored for high recovery of both polymer grade ethylene and propylene products. The simulation assumes ethylene product is delivered off plot in the vapor phase while propylene product is delivered as a liquid at ambient conditions. The proposed configuration can supply sub-cooled liquid ethylene and propylene products for atmospheric storage as required.

The simulated process configuration assumes the ethane product stream is sent off plot as a vapor at ambient conditions. To substantially increase the amount of ethylene produced, the ethane could be routed directly to a new furnace for cracking. The effluent from the new furnace could be routed into the olefins recovery section for processing.

Similar to the ethane product, the simulated process configuration assumes the propane stream is sent off plot to the LPG pool or as feed stock to the existing steam crackers. The propane stream is an excellent feed source and, like the ethane stream, could be cracked in a new furnace.

A purge stream containing mixed C4s can be blended into a LPG pool, hydrogenated and cracked in a new or existing furnace, sent to recover olefins as MTBE or Iso-octene/Isooctane, or fed to an alkylation unit. Mixed C4s can be recycled to the cracking units, which could be used to further increase propylene and ethylene yields while decreasing the mixed C4 product. As the recycle of C4s to the cracking units is increased, the net mixed C4s product stream become increasingly paraffinic, reducing or eliminating the need for hydrogenation if the C4 stream is routed to a cracking furnace.

BTX can be recovered from a stream consisting of C5s and predominantly BTX. Due to the high BTX content there is substantial incentive to recover the BTX in this stream. This will require that this entire stream be hydrotreated, and depentanized prior to being sent to the existing aromatics extraction unit. The raffinate from the aromatics extraction can be reprocessed in the cracking units converter or routed to a cracking furnace. If market conditions and BTX production is not attractive, the gasoline stream could also be blended into the gasoline pool provided the overall benzene content can be absorbed.

A tail gas stream of hydrogen and methane can be used for regenerating the dryers within the unit and then sent to the fuel gas system. Hydrogen recovery from this stream is possible, requiring additional purification equipment within the olefins recovery section. An evaluation should be made to determine if it is more economical to import hydrogen from existing sources rather than recovering hydrogen contained in the tailgas.

The light cycle oil and slurry oil streams from the main fractionator can be blended off with the existing refinery streams to be sold as fuel oil/Bunker fuel.

The asphaltene from the DAO unit can be sent to the solidification unit. The pelletized asphaltene product is an excellent solid fuel source that is easy to transport. The cement industry would be a primary choice for off take of this material. Other potential uses of the liquid asphaltene include gasification (which would generate power and hydrogen), blending to Bunker Fuel, or as feedstock to conversion processes such as partial oxidation, coking, or visbreaking.

Tables 2a, 2b, 2c, and 2d summarize simulated results for selected feed and product lines according to the process configuration of Table 1. The stream numbers correspond to FIGS. 1-4.

TABLE 2a

| Simulated Material Balance for the Overall System Configuration. | | | | | | |
|---|---|---|---|---|---|---|
| | Stream No. | | | | | |
| | 107 | 126 | 127 | 128 | 131 | 132 |
| Mass Fraction | | | | | | |
| Hydrogen | | | | | | |
| Oxygen | | | | | | |
| Nitrogen | | | | | | |
| Carbon Monoxide | | | | | | |
| Carbon Dioxide | | | | | | |
| Hydrogen Sulfide | | | | | | |
| Sulfur Oxides | | | | | | |
| Methane | | | | | | |
| Ethylene | | | | | | |
| Ethane | | | | | | |
| Propylene | | | | | | |
| Propane | | | | | | |
| Butenes | | | | | | |
| N-Butane | | | | | | |
| Isobutane | | | | | | |
| Light Naphtha (C5-79° C.) | | | | | | |
| Heavy Naphtha (79-221° C.) | | | | | | |
| Light Cycle Oil (221-360° C.) | | | | | | |
| Slurry (360° C.+) | | | | | | |
| Residue (190° C.+) | 1 | | | | | |
| Diesel (190-274° C.) | | 1 | | | | |
| Gas Oil (274-343° C.) | | | 1 | | | |

TABLE 2b

| Simulated Material Balance for the Overall System Configuration. | | | | | | |
|---|---|---|---|---|---|---|
| | Stream No. | | | | | |
| | 107 | 126 | 127 | 128 | 131 | 132 |
| Mass Fraction | | | | | | |
| Atm Residue (343° C.+) | | | | 1 | | |
| Deasphalted Oil | | | | | 1 | |
| Pitch | | | | | | 1 |
| Water | | | | | | |
| All Phases | | | | | | |
| Mass Flow, KG/HR | 771,196 | 90,753 | 74,556 | 605,887 | 375,650 | 230,237 |
| Temperature, ° C. | 252 | 68.2 | 65.6 | 336.6 | 176.7 | 273.9 |

TABLE 2b-continued

Simulated Material Balance for the Overall System Configuration.

| | Stream No. | | | | | |
|---|---|---|---|---|---|---|
| | 107 | 126 | 127 | 128 | 131 | 132 |
| Pressure, KG/CM$^2$-G | 4.35 | 0.14 | 0.39 | 0.56 | 0.45 | 3.52 |
| Vapor Phase | | | | | | |
| Mass Flow, KG/HR | | | | | | |
| Density, KG/CUM | | | | | | |
| Viscosity, CP | | | | | | |
| Molecular Wt. | | | | | | |
| Liquid Phase | | | | | | |
| Mass Flow, KG/HR | 771,196 | 90,753 | 74,556 | 605,887 | 375,650 | 230,237 |
| Density, KG/CUM | | 773.6 | 782.1 | 833.8 | 756 | 797 |
| API Gravity | 19.5 | 39.2 | 31.8 | 15.5 | 16.1 | −5.6 |
| Viscosity, CP | 4.1 | 2.4 | 13.6 | 5.8 | 14.0 | 593.0 |
| Molecular Wt. | 357 | 134 | 230 | 527 | 485 | 1075 |

TABLE 2c

Simulated Material Balance for the Overall System Configuration.

| | Stream No. | | | | | |
|---|---|---|---|---|---|---|
| | 136 | 143 | 478 | 476 | 482 | 484 |
| Mass Fraction | | | | | | |
| Hydrogen | | 0.0019 | | | | |
| Oxygen | | 0.001 | | | | |
| Nitrogen | | 0.0149 | | | | |
| Carbon Monoxide | | | | | | |
| Carbon Dioxide | | 0.0041 | | | | |
| Hydrogen Sulfide | | 0.0007 | | | | |
| Sulfur Oxides | | | | | | |
| Methane | | 0.0352 | | 0.0003 | | |
| Ethylene | | 0.067 | 0.0093 | 0.9995 | | |
| Ethane | | 0.0163 | 0.9696 | 0.0002 | 0.0003 | |
| Propylene | | 0.1844 | 0.0202 | | 0.9951 | 0.019 |
| Propane | | 0.047 | 0.0009 | | 0.0046 | 0.9576 |
| Butenes | | 0.1411 | | | | 0.0027 |
| N-Butane | | 0.0265 | | | | 0.0001 |
| Isobutane | | 0.0605 | | | | 0.0207 |
| Light Naphtha (C5-79° C.) | | 0.132 | | | | |
| Heavy Naphtha (79-221° C.) | | 0.119 | | | | |
| Light Cycle Oil (221-360° C.) | | 0.0626 | | | | |
| Slurry (360° C.+) | | 0.0283 | | | | |
| Residue (190° C.+) | | | | | | |
| Diesel (190-274° C.) | | | | | | |
| Gas Oil (274-343° C.) | 0.9972 | | | | | |

TABLE 2d

Simulated Material Balance for the Overall System Configuration.

| | Stream No. | | | | | |
|---|---|---|---|---|---|---|
| | 136 | 143 | 478 | 476 | 482 | 484 |
| Mass Fraction | | | | | | |
| Atm Residue (343° C.+) | | | | | | |
| Deasphalted Oil | | | | | | |
| Pitch | | | | | | |
| Water | 0.0028 | 0.0574 | | | | |
| All Phases | | | | | | |
| Mass Flow, KG/HR | 433,498 | 710,711 | 13,026 | 46,576 | 130,759 | 34,740 |
| Temperature, ° C. | 259.2 | 583.9 | 30 | 36.9 | 35 | 33.8 |
| Pressure, KG/CM$^2$-G | 21.72 | 0.99 | 10.1 | 25 | 21.6 | 20.23 |
| Vapor Phase | | | | | | |
| Mass Flow, KG/HR | | 710,711 | 13,026 | 46,576 | | |
| Density, KG/CUM | | 1.23 | 14.28 | 32.26 | | |
| Viscosity, CP | | 0.01 | 0.008 | 0.011 | | |
| Molecular Wt. | | 43.89 | 30.23 | 28.05 | | |
| Liquid Phase | | | | | | |
| Mass Flow, KG/HR | 433,498 | | | | 130,759 | 34,740 |

TABLE 2d-continued

| Simulated Material Balance for the Overall System Configuration. | | | | | | |
|---|---|---|---|---|---|---|
| | Stream No. | | | | | |
| | 136 | 143 | 478 | 476 | 482 | 484 |
| Density, KG/CUM | 995 | 758.7 | 553.7 | | | 488.5 |
| API Gravity | 26.4 | | | | — | 479.7 |
| Viscosity, CP | 0.5 | — | — | — | 0.08 | 0.08 |
| Molecular Wt. | 340 | | | | 42.1 | 44.3 |

In another example, mixed C4s can be recycled to the cracking units, which could be used to further increase propylene and ethylene yields while decreasing the mixed C4 product. Table 3 summarizes the simulated results for a process configured to recycle mixed C4s to the cracking units.

TABLE 3

| | MTD | BPD |
|---|---|---|
| External Feed Streams | | |
| Crude | 22,055 | 150,000 |
| Hydrogen | 261 | |
| Primary Product Streams | | |
| Fuel Gas | 1,260 | |
| Ethylene | 1,174 | |
| Ethane | 328 | |
| Propylene | 3,295 | |
| Propane | 876 | |
| Mixed C4s | 115 | |
| Naphtha from Cracker | 3,127 | |
| Naphtha from Existing Topping Unit | 3,545 | |
| Bunker Oil | 1,675 | |
| Pitch | 5,526 | |
| Sulfur | 256 | |
| Coke | 1,224 | |

In another example, the ethane can be routed directly to a new furnace for cracking to substantially increase the amount of ethylene yield. The effluent from the new furnace can be routed into the olefins recovery section for processing. Table 4 summarizes such simulated results.

TABLE 4

| | MTD | BPD |
|---|---|---|
| External Feed Streams | | |
| Crude | 22,055 | 150,000 |
| Hydrogen | 395 | |
| Primary Product Streams | | |
| Fuel Gas | 1,998 | |
| Ethylene | 2,599 | |
| Ethane | 0 | |
| Propylene | 3,795 | |
| Propane | 0 | |
| Mixed C4s | 0 | |
| Naphtha from Cracker | 2,021 | |
| Naphtha from Existing Topping Unit | 3,545 | |
| Bunker Oil | 1,574 | |
| Pitch | 5,526 | |
| Sulfur | 256 | |
| Coke | 1,130 | |

In yet another example, the process can be configured to maximize transportation fuels, as shown in Table 5.

TABLE 5

| Simulated results tailored to maximize transportation fuels. | | |
|---|---|---|
| | MTD | BPD |
| External Feed Streams | | |
| Crude | 22,055 | 150,000 |
| Hydrogen | 264 | |
| Primary Product Streams | | |
| Fuel Gas | 504 | |
| Ethylene | 527 | |
| Ethane | 152 | |
| Propylene | 1,381 | |
| Propane | 448 | |
| Mixed C4s | 688 | |
| Diesel | 5900 | |
| Naphtha from Cracker | 2,289 | |
| Naphtha from Existing Topping Unit | 3,545 | |
| Bunker Oil | 568 | |
| Pitch | 5,526 | |
| Sulfur | 256 | |
| Coke | 532 | |

The estimated utilities associated with the proposed configurations are reported in Table 6. Very high pressure (VHP) steam can be internally generated and entirely consumed in the unit. If import steam demand is higher than desired, some of the major turbine drivers could be switched from steam turbines to electric motors.

TABLE 6

| Estimated Utilities | | |
|---|---|---|
| Description | Units | Value |
| HP Steam, 43.5 kg/cm$^2$-g, 399° C. | MTH | 561 |
| MP Steam, 19.3 kg/cm$^2$-g, 271° C. | MTH | 52 |
| LP Steam, 4.5 kg/cm$^2$-g, 156° C. | MTH | (42) |
| Fuel Gas | GCAL/H | (387) |
| Electricity | MW | 38.7 |
| Cooling Water (1) | M3/H | 43,815 |
| Boiler Feed Water | M3/H | 354 |
| Plant Air | MTH | 2.5 |

Notes:
(1) Based on 10° C. temperature rise.
2. Export values are denoted in parenthesis ( ).

Tables 7-9 report simulated feed and product specifications of certain streams. In particular, Table 7 reports the crude feed (stream no. 103) properties; Table 8 reports the DAO (stream no. 131) properties; and Table 9 reports the hydro-processed Gas Oil product (stream no. 136) specification.

TABLE 7

Specifications of the crude feed corresponding to stream no. 103 in the Figures.

| Property | Method | Value |
|---|---|---|
| Specific Gravity @ 15.6/15.6° C. | ASTM D-1298 | 0.9251 |
| API Gravity | ASTM D-287 | 21.46 |
| Viscosity cSt @: | | |
| 15.6° C. | | 322.90 |
| 21° C. | | 223.44 |
| 25° C. | | 175.20 |
| Conradson Carbon, wt % | ASTM D-189 | 11.73 |
| Total Nitrogen, ppm | ASTM D-664 | 0.26 |
| Sulfur, ppm | UOP-163 | 92 |
| Mercaptans, ppm | UOP-163 | 114 |
| Naphthenes, vol % | | 15.85 |
| Aromatics, vol % | | 15.32 |
| Total paraffins, vol % | | 66.68 |
| Metals, ppm | | |
| Nickel | | 54.34 |
| Vanadium | | 241.07 |
| Iron | | 2.45 |
| Copper | | 0.42 |

TABLE 8

Deasphalted Oil Product Specification

| Property | Method | Value |
|---|---|---|
| Specific Gravity @ 15.6/15.6° C. | ASTM D-1298 | 0.9585 |
| API Gravity | ASTM D-287 | 16.1 |
| Viscosity, cSt @: | | |
| 99° C. | | 40 |
| 135° C. | | 15 |
| Conradson Carbon, wt % | ASTM D-189 | 2.8 |
| Total Nitrogen, wt % | ASTM D-664 | 0.20 |
| Sulfur, wt % | UOP-163 | 3.4 |
| Metals, wppm | | |
| Nickel | | 2.0 |
| Vanadium | | 12.2 |

TABLE 9

Hydro-processed Gas Oil Product Specification

| Property | Method | Value |
|---|---|---|
| Specific Gravity @ 15.6/15.6° C. | ASTM D-1298 | 0.8960 |
| API Gravity | ASTM D-287 | 26.44 |
| Conradson Carbon, wt % | ASTM D-189 | 0.7 |
| Total Nitrogen, wppm | ASTM D-664 | 312 |
| Sulfur, wppm | UOP-163 | 1197 |
| Metals, wppm | | |
| Nickel | | 0.03 |
| Vanadium | | 0.1 |

Simulated final product specifications and properties for the Ethylene, Propylene, Mixed C4, Ethane, Propane, Fuel gas, Naphtha, Bunker Oil, and Asphaltene are listed in Tables 10 through 18, respectively.

TABLE 10

Ethylene Product Specification

| | Units | Value |
|---|---|---|
| Ethylene | vol % | 99.9 min |
| Methane + Ethane | ppmv | 1000 max |
| Ethane | ppmv | 500 max |
| $C_3 + C_4$ | ppmv | 10 max |
| Acetylene | ppmv | 5 max |
| Hydrogen | ppmv | 5 max |
| Oxygen | ppmv | 5 max |
| Carbon monoxide | ppmv | 2 max |
| Carbon dioxide | ppmv | 5 max |
| Water | ppmw | 5 max |
| Total Basic Nitrogen (as $NH_3$) | ppmw | 1.0 max |
| Acetone + Methanol + n-Propanol | ppmv | 10 max |
| Total Sulfur (as S) | ppmw | 1 max |
| Conditions | | |
| Temperature, ° C. | | 37 |
| Pressure, kg/cm$^2$-g | | 25.0 |

TABLE 11

Propylene Product Specification

| | Units | Value |
|---|---|---|
| Propylene | vol % | 99.5 min |
| Propane | vol % | 0.5 max |
| Ethylene | ppmv | 100 max |
| Ethane | ppmv | 100 max |
| Methyl acetylene | ppmv | 5 max |
| Propadiene | ppmv | 5 max |
| Butene + Butadiene | ppmv | 10 max |
| Carbon monoxide | ppmv | 5 max |
| Carbon dioxide | ppmv | 10 max |
| Oxygen | ppmv | 2 max |
| Water | ppmw | 5 max |
| Total Sulfur (as S) | ppmw | 1 max |
| Condition | | |
| Temperature, ° C. | | 35 |
| Pressure, kg/cm$^2$-g | | 21.5 |

TABLE 12

Mixed C4 Product Specification

| | Units | Value |
|---|---|---|
| C3's | vol % | <1.0 |
| Butenes | vol % | 61.7 |
| N-Butane | vol % | 11.4 |
| I-Butane | vol % | 25.8 |
| C5's | vol % | <1.0 |
| Condition | | |
| Temperature, ° C. | | 44 |
| Pressure, kg/cm$^2$-g | | 4.1 |

TABLE 13

Ethane Product Specification

| | Units | Value |
|---|---|---|
| Ethylene | vol % | 1.0 |
| Ethane | vol % | 97.5 |
| C3's | vol % | 1.5 |
| Condition | | |
| Temperature, ° C. | | 30 |
| Pressure, kg/cm$^2$-g | | 10.1 |

TABLE 14

| Propane Product Specification | Units | Value |
|---|---|---|
| Propylene | vol % | 2.0 |
| Propane | vol % | 96.2 |
| C4's | vol % | 1.8 |
| Condition | | |
| Temperature, ° C. | | 34 |
| Pressure, kg/cm$^2$-g | | 20.2 |

TABLE 15

| Fuel Gas Product Specification | Units | Value |
|---|---|---|
| Hydrogen | vol % | 29.7 |
| Nitrogen | vol % | 11.5 |
| Methane | vol % | 58.1 |
| Ethylene | vol % | <1.0 |
| Condition | | |
| Temperature, ° C. | | 30 |
| Pressure, kg/cm$^2$-g | | 10.8 |

TABLE 16

| Naphtha Product Specification | Units | Value |
|---|---|---|
| C4's | wt % | 0.4 |
| Methylbutenes | wt % | 4.2 |
| I-Pentane | wt % | 7.1 |
| N-Pentane | wt % | 1.3 |
| Pentenes | wt % | 2.3 |
| Cyclopentadiene | wt % | 0.9 |
| Pentadiene | wt % | 0.2 |
| Other C5's | wt % | 2.1 |
| C6 Olefins | wt % | 2.3 |
| C6 Saturates | wt % | 4.7 |
| Benzene | wt % | 4.8 |
| Toluene | wt % | 13.5 |
| Ethylbenzene | wt % | 1.9 |
| p-Xylene | wt % | 4.6 |
| m-Xylene | wt % | 7.8 |
| o-Xylene | wt % | 3.6 |
| Other C7+ | wt % | 38.3 |
| Condition | | |
| Temperature, ° C. | | 39 |
| Pressure, kg/cm$^2$-g | | 6.9 |

TABLE 17

| Bunker Oil Product Specification | Method | Value |
|---|---|---|
| Property | | |
| Specific Gravity @ 15.6/15.6° C. | ASTM D-1298 | 0.9659 |
| API Gravity | ASTM D-287 | 15.0 |
| Distillation Curve | ASTM D86 | |
| 0 Vol % | | 135° C. |
| 5 Vol % | | 235° C. |
| 10 Vol % | | 242° C. |
| 30 Vol % | | 271° C. |
| 50 Vol % | | 304° C. |
| 70 Vol % | | 354° C. |
| 90 Vol % | | 468° C. |

TABLE 17-continued

| Bunker Oil Product Specification | Method | Value |
|---|---|---|
| 95 Vol % | | 513° C. |
| 100 Vol % | | 555° C. |
| Condition | | |
| Temperature, ° C. | | 74 |
| Pressure, kg/cm$^2$-g | | 4.0 |

TABLE 18

| Asphaltene Product Specification | Method | Value |
|---|---|---|
| Property | | |
| Specific Gravity @ 15.6/15.6° C. | ASTM D-1298 | 1.124 |
| API Gravity | ASTM D-287 | −5.6 |
| Viscosity cSt @: | | |
| 200° C. | | 6182 |
| 250° C. | | 528 |
| Conradson Carbon, wt % | ASTM D-189 | 42.3 |
| Nitrogen Total, wt % | ASTM D-664 | 0.95 |
| Sulfur, wt % | UOP-163 | 6.92 |
| Metals, wppm | | |
| Nickel | | 214 |
| Vanadium | | 986 |
| Heating Value, Kcal/kg | | 9.445 |
| R&B Softening Point, ° C. | | 138 |

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While the foregoing can be directed to embodiments of the present invention, other and further embodiments of the invention may be devised without departing from the basic scope thereof, and the scope thereof can be determined by the claims that follow.

What is claimed is:

1. A method for processing hydrocarbons, comprising:

distilling a hydrocarbon to provide a distillate, a gas oil, and a residue, wherein the residue comprises asphaltenes and non-asphaltenes;

mixing the residue with a solvent to provide a mixture;

selectively separating the asphaltenes from the mixture to provide a deasphalted oil;

hydroprocessing at least a portion of the deasphalted oil and at least a portion of the gas oil to provide a hydroprocessed hydrocarbon;

cracking at least a portion of the distillate and at least a portion of the hydroprocessed hydrocarbon in a first reaction zone to provide a first cracked product comprising $C_2$ hydrocarbons, $C_3$ hydrocarbons, $C_4$ hydrocarbons, and naphtha;

cracking at least a portion of a recycle hydrocarbon comprising $C_4$ hydrocarbons and light naphtha in a second reaction zone to provide a second cracked product comprising $C_2$ hydrocarbons and $C_3$ hydrocarbons, wherein the recycle hydrocarbon is recovered from the first cracked product;

mixing the first cracked product and the second cracked product to provide a mixed product; and selectively separating the mixed product to provide the recycle hydrocarbon and one or more hydrocarbon products comprising at least one of ethylene, ethane, propylene, propane, fuel gas, mixed $C_4$ hydrocarbons, naphtha, and bunker oil.

* * * * *